US007618118B2

(12) United States Patent
Taira

(10) Patent No.: US 7,618,118 B2
(45) Date of Patent: Nov. 17, 2009

(54) INKJET HEAD THAT IMPROVES FLATNESS OF INK EJECTION SURFACE

(75) Inventor: Hiroshi Taira, Ichinomiya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 253 days.

(21) Appl. No.: 11/018,511

(22) Filed: Dec. 22, 2004

(65) Prior Publication Data

US 2005/0140723 A1 Jun. 30, 2005

(30) Foreign Application Priority Data

Dec. 25, 2003 (JP) ..... 2003-429159

(51) Int. Cl.
*B41J 2/15* (2006.01)

(52) U.S. Cl. ..... 347/40; 347/42; 347/17; 347/18; 347/49; 347/68

(58) Field of Classification Search ..... 347/40, 347/42, 17, 18, 49, 68
See application file for complete search history.

(56) References Cited

U.S. PATENT DOCUMENTS 6,109,727 A 8/2000 Akahira et al.
6,217,158 B1 * 4/2001 Kanaya et al. ..... 347/70
6,505,908 B1 * 1/2003 Akahira et al. ..... 347/18
2002/0005879 A1 * 1/2002 Kitahara ..... 347/68
2003/0156157 A1 * 8/2003 Suzuki et al. ..... 347/50

FOREIGN PATENT DOCUMENTS

JP A 10-151748 6/1998

* cited by examiner

*Primary Examiner*—Matthew Luu
*Assistant Examiner*—Henok Legesse
(74) *Attorney, Agent, or Firm*—Oliff & Berridge, PLC

(57) ABSTRACT

A channel unit has an ink ejection surface that includes nozzles, another surface, a common ink chamber, pressure chambers, and individual ink channels each fluidly connecting the common ink chamber with one nozzle via a corresponding pressure chamber. An actuator unit is fixed to the another surface. The actuator unit is deformable to selectively change the volumes of the plurality of pressure chambers. A reservoir unit has a first surface fixed to the another surface, a second surface extending in parallel with the ink ejection surface, and an ink reservoir. The actuator unit is interposed between the channel unit and the reservoir unit. A base plate has a flat planar surface. A fixing portion fixes the base plate to the reservoir unit at at least one position, allowing the flat planar surface of the base plate to be in close contact with the second surface of the reservoir unit.

18 Claims, 13 Drawing Sheets

INKJET HEAD THAT IMPROVES FLATNESS OF INK EJECTION SURFACE

BACKGROUND OF THE INVENTION

1. Field of the Invention

The present invention relates to an inkjet head used in printing operations for ejecting ink onto a recording medium, an inkjet head assembly equipped with a plurality of the inkjet heads, and an inkjet printer having the inkjet head assembly.

2. Description of Related Art

Japanese patent-application publication No. HEI-10-151748 discloses an inkjet head having a plurality of nozzles arranged linearly. A plate is fixed to a side surface of the inkjet head with three fixing bolts disposed along the longitudinal direction of the plate. The side surface is orthogonal to an ink ejection surface on which nozzles are formed. A plurality of adjusting bolts is disposed between the fixing bolts for correcting minor warping in the inkjet head that may result from manufacturing. By correcting such minor warping with this technology, the nozzles can be aligned linearly along the longitudinal direction of the inkjet head.

SUMMARY OF THE INVENTION

However, the technology in Japanese patent-application publication No. HEI-10-151748 functions to align nozzles formed in the ink ejection surface orthogonal to the side surface on which the plate is attached by pushing in or pulling out the side surface with bolts, but cannot adjust warping or bending in the ink ejection surface itself. Hence, the flatness of the ink ejection surface in the inkjet head remains poor. As a result, the distances between nozzles and the recording medium are irregular, reducing the accuracy with which ink ejected from the nozzles hits the recording medium.

In view of the foregoing, it is an object of the present invention to provide an inkjet head capable of improving the flatness of the ink ejection surface and suppressing variations in ink ejecting accuracy; an inkjet head assembly; and an inkjet printer equipped with the inkjet head assembly.

In order to attain the above and other objects, the present invention provides an inkjet head. The inkjet head includes a channel unit, an actuator unit, a reservoir unit, a base plate, and a fixing portion. The channel unit has an ink ejection surface that includes a plurality of nozzles for ejecting ink, another surface opposite to the ink ejection surface, a common ink chamber, a plurality of pressure chambers each having a volume, and a plurality of individual ink channels each fluidly connecting the common ink chamber with one of the plurality of nozzles via a corresponding one of the plurality of pressure chambers. The actuator unit is fixed to a portion of the another surface. The actuator unit is deformable to selectively change the volumes of the plurality of pressure chambers, thereby applying pressure to ink therein. The reservoir unit has a first surface fixed to another portion of the another surface, a second surface being opposite to the first surface and extending in parallel with the ink ejection surface, and an ink reservoir accommodating ink to be supplied to the common ink chamber. The actuator unit is interposed between the channel unit and the reservoir unit. The base plate has a flat planar surface. The fixing portion fixes the base plate to the reservoir unit at at least one position, allowing the flat planar surface of the base plate to be in close contact with the second surface of the reservoir unit.

The present invention also provides an inkjet head assembly. The inkjet head assembly includes a frame and a plurality of inkjet heads. Each of the plurality of inkjet heads includes a channel unit, an actuator unit, a reservoir unit, a base plate, and a fixing portion. The channel unit has an ink ejection surface that includes a plurality of nozzles for ejecting ink, another surface opposite to the ink ejection surface, a common ink chamber, a plurality of pressure chambers each having a volume, and a plurality of individual ink channels each fluidly connecting the common ink chamber with one of the plurality of nozzles via a corresponding one of the plurality of pressure chambers. The actuator unit is fixed to a portion of the another surface. The actuator unit is deformable to selectively change the volumes of the plurality of pressure chambers, thereby applying pressure to ink therein. The reservoir unit has a first surface fixed to another portion of the another surface, a second surface being opposite to the first surface and extending in parallel with the ink ejection surface, and an ink reservoir accommodating ink to be supplied to the common ink chamber. The actuator unit is interposed between the channel unit and the reservoir unit. The base plate has a flat planar surface and is supported by the frame. The fixing portion fixes the base plate to the reservoir unit at at least one position, allowing the flat planar surface of the base plate to be in close contact with the second surface of the reservoir unit.

The present invention also provides another inkjet head assembly. The inkjet head assembly includes a plurality of inkjet heads, a base plate, and a fixing portion. Each of the plurality of inkjet heads includes a channel unit, an actuator unit, and a reservoir unit. The channel unit has an ink ejection surface that includes a plurality of nozzles for ejecting ink, another surface opposite to the ink ejection surface, a common ink chamber, a plurality of pressure chambers each having a volume, and a plurality of individual ink channels each fluidly connecting the common ink chamber with one of the plurality of nozzles via a corresponding one of the plurality of pressure chambers. The actuator unit is fixed to a portion of the another surface. The actuator unit is deformable to selectively change the volumes of the plurality of pressure chambers, thereby applying pressure to ink therein. The reservoir unit has a first surface fixed to another portion of the another surface, a second surface being opposite to the first surface and extending in parallel with the ink ejection surface, and an ink reservoir accommodating ink to be supplied to the common ink chamber. The actuator unit is interposed between the channel unit and the reservoir unit. The base plate has a flat planar surface. The fixing portion fixes the base plate to each reservoir unit at at least one position, allowing the flat planar surface of the base plate to be in close contact with the second surface of each reservoir unit.

The present invention also provides an inkjet printer. The inkjet printer includes a main chassis, a recording-medium conveying unit, and an inkjet head assembly. The recording-medium conveying unit has a conveying surface for conveying a recording medium thereon. The inkjet head assembly includes a frame and a plurality of inkjet heads. The frame is supported by the main chassis. Each of the plurality of inkjet heads includes a channel unit, an actuator unit, a reservoir unit, a base plate, and a fixing portion. The channel unit has an ink ejection surface that includes a plurality of nozzles for ejecting ink, another surface opposite to the ink ejection surface, a common ink chamber, a plurality of pressure chambers each having a volume, and a plurality of individual ink channels each fluidly connecting the common ink chamber with one of the plurality of nozzles via a corresponding one of the plurality of pressure chambers. The actuator unit is fixed to a portion of the another surface. The actuator unit is deformable to selectively change the volumes of the plurality of pressure chambers, thereby applying pressure to ink therein. The reservoir unit has a first surface fixed to another portion of the another surface, a second surface being opposite to the first surface and extending in parallel with the ink ejection surface, and an ink reservoir accommodating ink to be supplied to the common ink chamber. The actuator unit is interposed between the channel unit and the reservoir unit. The base plate has a flat planar surface and is supported by the frame. The fixing portion fixes the base plate to the reservoir unit at at least one position, allowing the flat planar surface of the base plate to be in close contact with the second surface of the reservoir unit.

BRIEF DESCRIPTION OF THE DRAWINGS

The above and other objects, features and advantages of the invention will become more apparent from reading the following description of the embodiments taken in connection with the accompanying drawings in which:

FIG. 3(*b*) is a cross-sectional view along a line IIIB-IIIB in FIG. 3(*a*);

FIG. 4(*b*) is a plan view showing the inkjet head according to the first embodiment;

FIG. 9(*b*) is a plan view showing an individual electrode on the actuator unit depicted in FIG. 9(*a*);

FIG. 13(*b*) is a plan view showing part of the inkjet head assembly according to the second embodiment.

DETAILED DESCRIPTION OF THE PREFERRED EMBODIMENTS

An inkjet head, inkjet head assembly, and inkjet printer according to embodiments of the present invention will be described while referring to the accompanying drawings.

Figure 1:
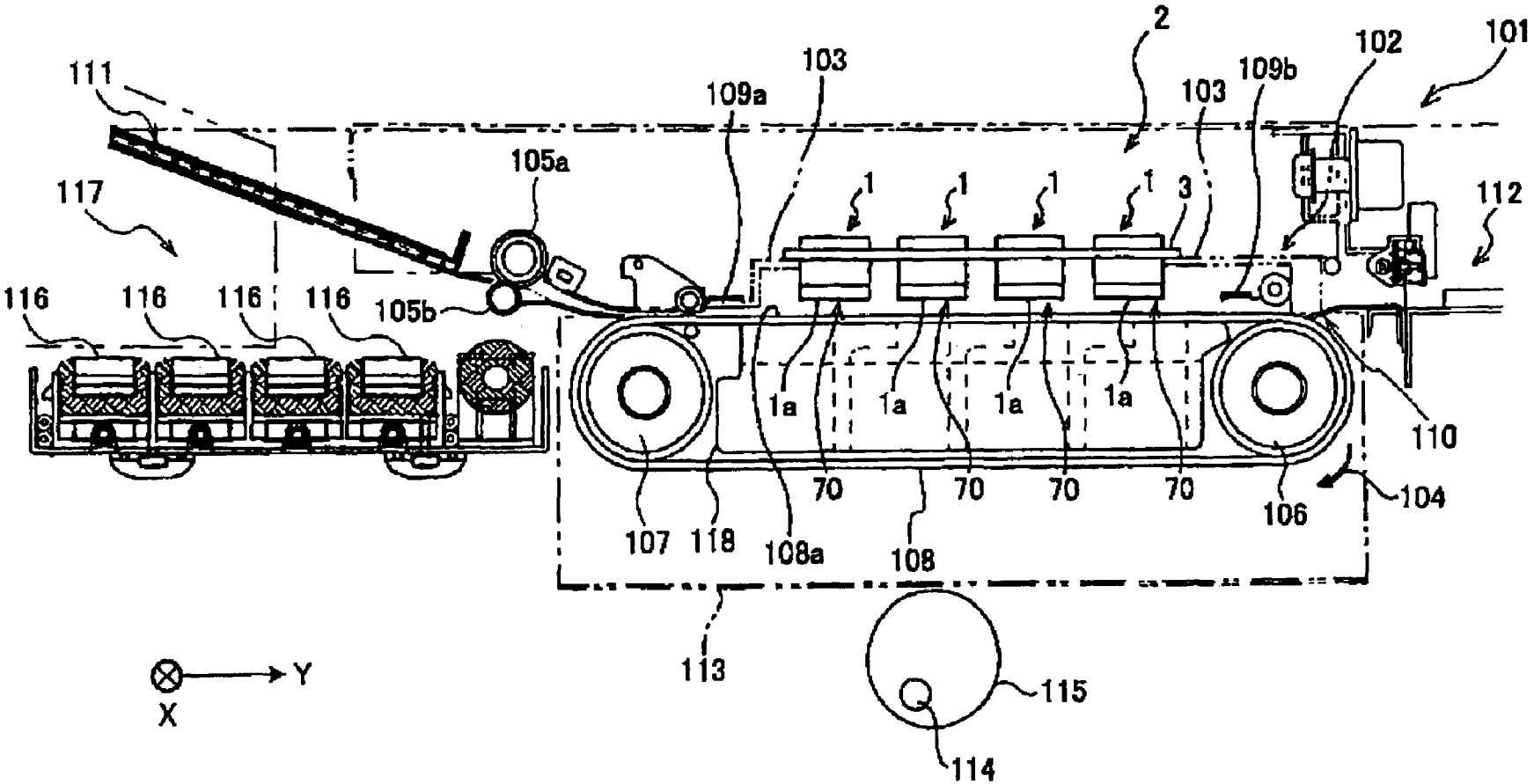
FIG. 1 is an explanatory diagram of an inkjet printer having inkjet heads according to a first embodiment of the present invention.

FIG. 1 is a schematic diagram showing an inkjet printer having inkjet heads according to a first embodiment of the present invention. An inkjet printer 101 shown in FIG. 1 is a color inkjet printer having four inkjet heads 1. A paper supply unit 111 is disposed on the left side of the inkjet printer 101 in FIG. 1, while a discharge unit 112 is disposed on the right side of the drawing.

Paper is conveyed along a paper conveying path formed in the inkjet printer 101 from the paper supply unit 111 to the discharge unit 112. A pair of conveying rollers 105*a* and 105*b* for pinching and conveying paper loaded in the paper supply unit 111 is disposed on the downstream end of the paper supply unit 111. Paper is conveyed from the left side of the drawing toward the right by the conveying rollers 105*a* and 105*b*. Two belt rollers 106 and 107 and an endless conveying belt 108 looped around the belt rollers 106 and 107 are disposed in the central area of the paper conveying path. The outer surface of the conveying belt 108, that is, a paper conveying surface 108*a*, is subjected to a silicon treatment to generate a tackiness on the conveying surface. Paper supplied by the conveying rollers 105*a* and 105*b* is gripped by the tacky paper conveying surface 108*a* and conveyed downstream (toward the right) by the clockwise rotation of the belt roller 106 (indicated by an arrow 104 in FIG. 1).

Pushing members 109*a* and 109*b* are disposed at insertion and discharge positions, respectively, over the conveying belt 108. The pushing members 109*a* and 109*b* push the paper against the paper conveying surface 108*a* so that the paper is reliably gripped by the paper conveying surface 108*a* and does not float up from the paper conveying surface 108*a*.

A separating mechanism 110 is disposed immediately downstream of the conveying belt 108 along the paper conveying path. The separating mechanism 110 peels the paper from the paper conveying surface 108*a* so that the paper is conveyed rightward toward the discharge unit 112.

The four inkjet heads 1 corresponding to the four ink colors magenta, yellow, cyan, and black are arranged in a series along the paper conveying direction. Specifically, the inkjet printer 101 in the present embodiment is a line printer. In a plan view, the inkjet heads 1 are narrow rectangular shapes elongated in the longitudinal direction (main scanning direction X) orthogonal to the paper conveying direction (subscanning direction Y). On the bottom of each inkjet head 1 is a main head member 70 configured of a channel unit in which are formed ink channels having pressure chambers fixed to an actuator for applying pressure to ink in the ink chambers. A plurality of microchannels is formed in rows on the bottom surface of the main head member 70. Ink is ejected downward through these nozzles. Hereinafter, the bottom surface of the inkjet head 1 will be referred to as a nozzle surface (ink ejection surface) 1*a*.

The main head members 70 are disposed such that the nozzle surfaces 1*a* and the paper conveying surface 108*a* of the conveying belt 108 are parallel to one another and a small gap functioning as the paper conveying path is formed therebetween. With this construction, ink of each color is ejected from the nozzles toward the top surface of the paper, that is, the printing surface, as the paper conveyed on the conveying belt 108 passes directly under each of the main head members 70 in sequence, thereby forming a desired color image on the paper.

The inkjet printer 101 is also provided with a maintenance unit 117 for automatically performing maintenance on the inkjet heads 1. The maintenance unit 117 is provided with four caps 116 for covering the nozzle surfaces 1*a* of the four main head members 70, a purging mechanism (not shown), and the like.

The maintenance unit 117 is positioned directly below the paper supply unit 111 (a withdrawn position) when the inkjet printer 101 is performing a printing operation. However, when a predetermined condition is met after completing a printing operation (for example, if a predetermined time has elapsed in which no printing operation has been executed, or if an operation is performed to turn off the power to the inkjet printer 101), then the maintenance unit 117 is moved to a position directly below the main head members 70 (a cap position), at which position the caps 116 cover the nozzle surfaces 1*a* of each main head member 70 to prevent ink in the nozzle portions of the main head members 70 from drying out. The belt rollers 106 and 107 and the conveying belt 108 are supported in a chassis 113. The chassis 113 rests on a cylindrical member 115 disposed below the chassis 113. The cylindrical member 115 can rotate about a shaft 114 disposed at an eccentric position in the cylindrical member 115. As the shaft 114 rotates, the height of the cylindrical member 115 changes to raise and lower the chassis 113. In order to move the maintenance unit 117 from the withdrawn position to the cap position, it is necessary to rotate the cylindrical member 115 to a predetermined appropriate angle and lower the conveying belt 108 and belt rollers 106 and 107 an appropriate distance from the position shown in FIG. 1 in order to open sufficient space for moving the maintenance unit 117.

A guide 118 is disposed in an area surrounded by the conveying belt 108 at a position confronting the inkjet heads 1. The guide 118 is shaped substantially like a rectangular parallelepiped having a width similar to the conveying belt 108 and contacts the bottom surface of the conveying belt 108 on the top side of the loop for supporting the conveying belt 108 from the inner side.

Figure 2:
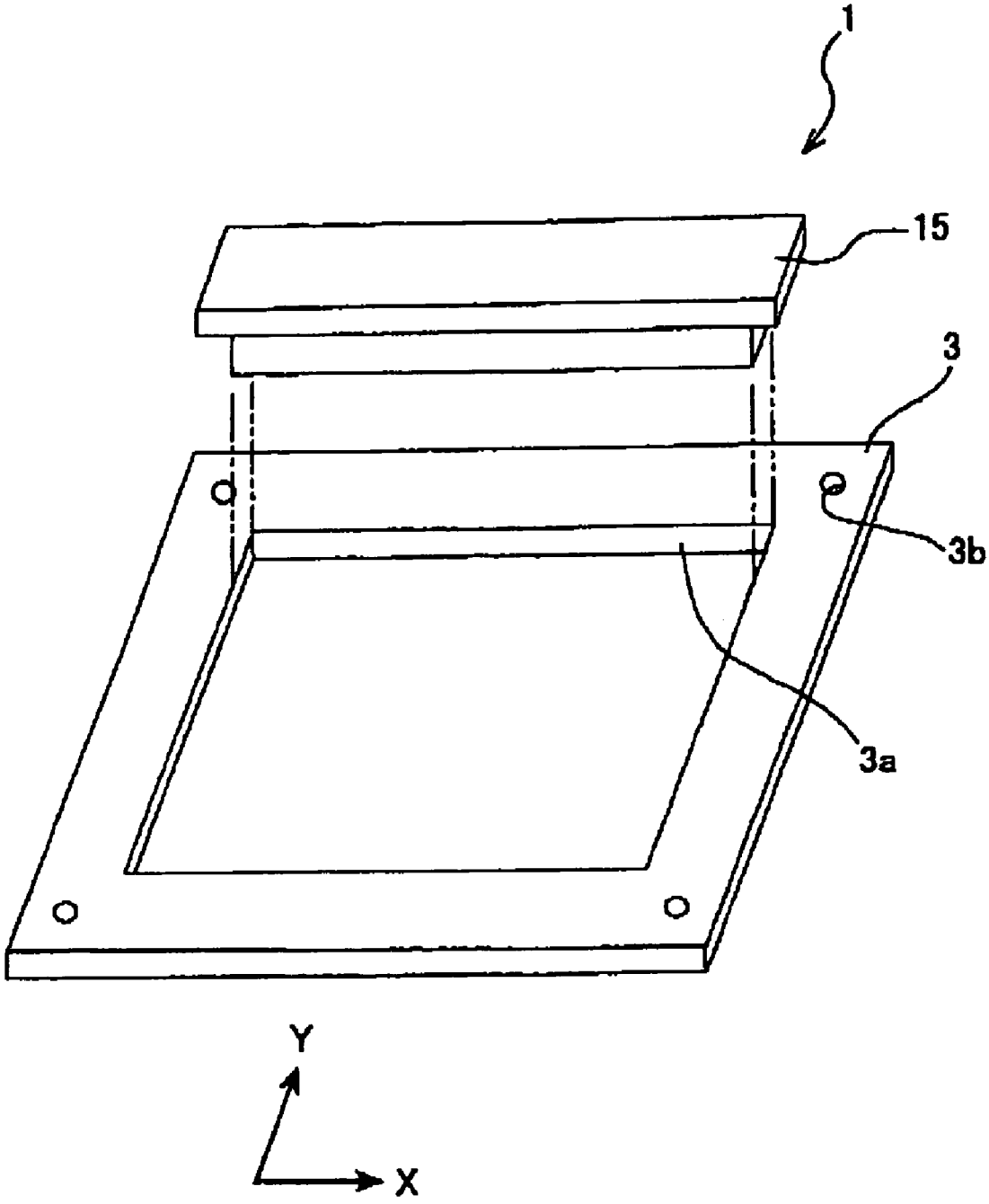
FIG. 2 is a perspective view showing the inkjet head of the first embodiment being mounted in a frame.

Next, an inkjet head assembly according to the present embodiment for providing a plurality of the inkjet heads 1 as a unit will be described. FIG. 2 is a perspective view showing the inkjet head 1 of the present embodiment being mounted in a frame 3. The frame 3 includes an opening 3*a* substantially square in shape and formed inside the frame 3; and through-holes 3*b* formed one in each of the four corners of the frame 3. The inkjet head 1 shown in FIG. 2 is mounted on the frame 3 so that the main head member 70 is inserted into the opening 3*a*. Four of the inkjet heads 1 are arranged adjacent to one another on the frame 3 in a series extending orthogonal to the longitudinal direction of the inkjet heads 1 (main scanning direction X) and are fixed to the frame 3 by bolts 17 (FIG. 4(*a*)), thereby completing an inkjet head assembly 2. As shown in FIG. 1, the inkjet head assembly 2 is disposed so that the frame 3 rests on a supporting portion 103. The supporting portion 103 protrudes toward the inkjet head assembly 2 from a main chassis 102 of the inkjet printer 101. The frame 3 is fixed to the supporting portion 103 by screws (not shown) inserted through the through-holes 3*b*. The supporting portion 103 protrudes from the main chassis 102 and extends parallel to the paper conveying surface 108*a*. When the inkjet head assembly 2 is fixed to the supporting portion 103, the bottom surface of a base plate (reference plate) 15 disposed on the top of each inkjet head 1 (FIG. 2) is parallel to the paper conveying surface 108*a*.

Figure 3A:
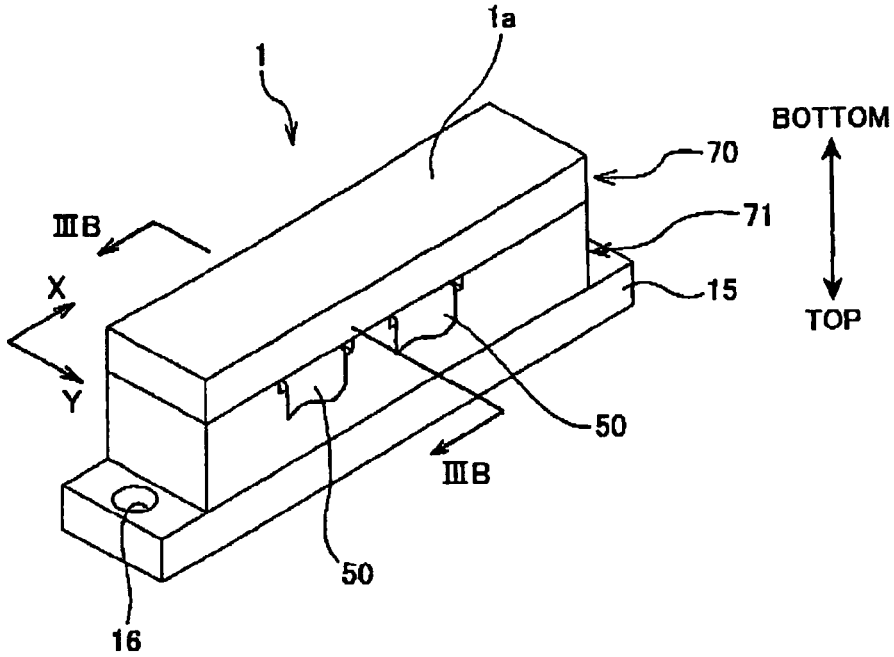
FIG. 3(*a*) is a perspective view showing the inkjet head of the first embodiment upside down.
Figure 3B:
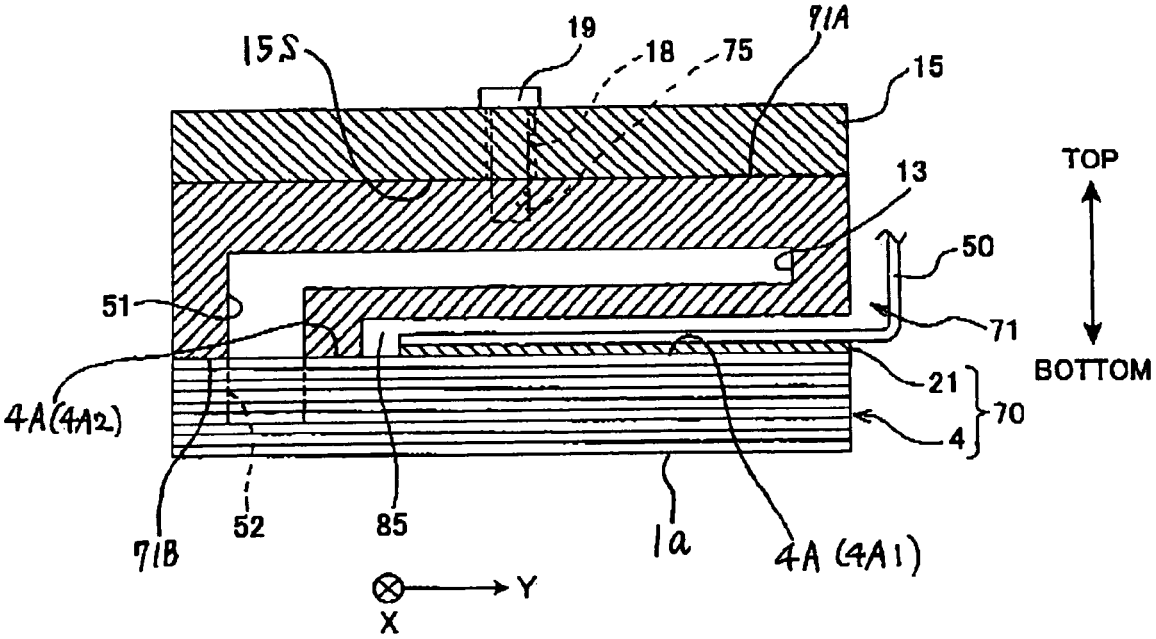

Next, the structure of the inkjet head 1 according to the present embodiment will be described in greater detail. FIGS. 3(*a*) and 3(*b*) show the inkjet head 1 according to the present embodiment. FIG. 3(*a*) is a perspective view showing the inkjet head 1 flipped upside down, while FIG. 3(*b*) is a cross-sectional view along the line IIIB-IIIB in FIG. 3(*a*), wherein the inkjet head 1 is oriented in the right direction (the direction in which the inkjet printer 101 is intended to be used). As shown in FIGS. 3(*a*) and 3(*b*), the inkjet head 1 includes the main head member 70 having a rectangular planar shape that extends in the main scanning direction X and serving to eject ink onto paper; a reservoir unit 71 disposed on top of the main head member 70 and having ink reservoirs 13 formed therein for storing ink to be supplied to the main head member 70; and the base plate 15 disposed above the reservoir unit 71 and having a base surface 15S that confronts the reservoir unit 71 and is parallel to the nozzle surface 1*a* and the paper conveying surface 108*a*. The reservoir unit 71 has a top surface 71A and a bottom surface 71B. The top surface 71A is opposite to the bottom surface 71B, and extends in parallel with the nozzle surface 1*a*. The base surface 15S is formed as a flat surface.

As shown in FIGS. 3(*b*) and 5, the main head member 70 includes: a channel unit 4 in which ink channels are formed and having a top surface 4A and the nozzle surface 1*a*; and a plurality of (four, in this embodiment) actuator units 21 bonded to the top surface 4A of the channel unit 4. Each actuator unit 21 has a laminated structure in which a plurality of thin plates are stacked and bonded together as will be described with reference to FIG. 7.

As shown in FIGS. 3(*b*) and 4(*a*), each actuator unit 21 is fixed to a portion 4A1 of the top surface 4A of the channel unit 4. The bottom surface 71B of the reservoir unit 71 is fixed to another portion 4A2 of the top surface 4A of the channel unit 4. Accordingly, the actuator unit 21 is interposed between the channel unit 4 and the reservoir unit 71.

As shown in FIGS. 3(*b*), 10, and 11, the reservoir unit 71 is formed with a plurality of upper ink supply channels 51. The upper ink supply channels 51 are for supplying ink stored in the ink reservoirs 13 to the main head member 70. The upper ink supply channels 51 extend downward and are opened on the bottom surface of the reservoir unit 71. The reservoir unit 71 contacts the channel unit 4 only at portions surrounding the openings of the upper ink supply channels 51 on the bottom surface of the reservoir unit 71. Accordingly, remaining regions of the reservoir unit 71 other than the portions surrounding the upper ink supply channels 51 are located separate from the main head member 70, forming a space 85. The actuator units 21 are disposed in the space 85. The contact surface between the reservoir unit 71 and the channel unit 4 is parallel to the base surface 15S of the base plate 15. Further, flexible printed circuits (FPCs) 50 are electrically connected to the top surfaces of the actuator units 21. The FPCs 50 are drawn out from both sides of the actuator units 21 in the subscanning direction Y.

Figure 5:
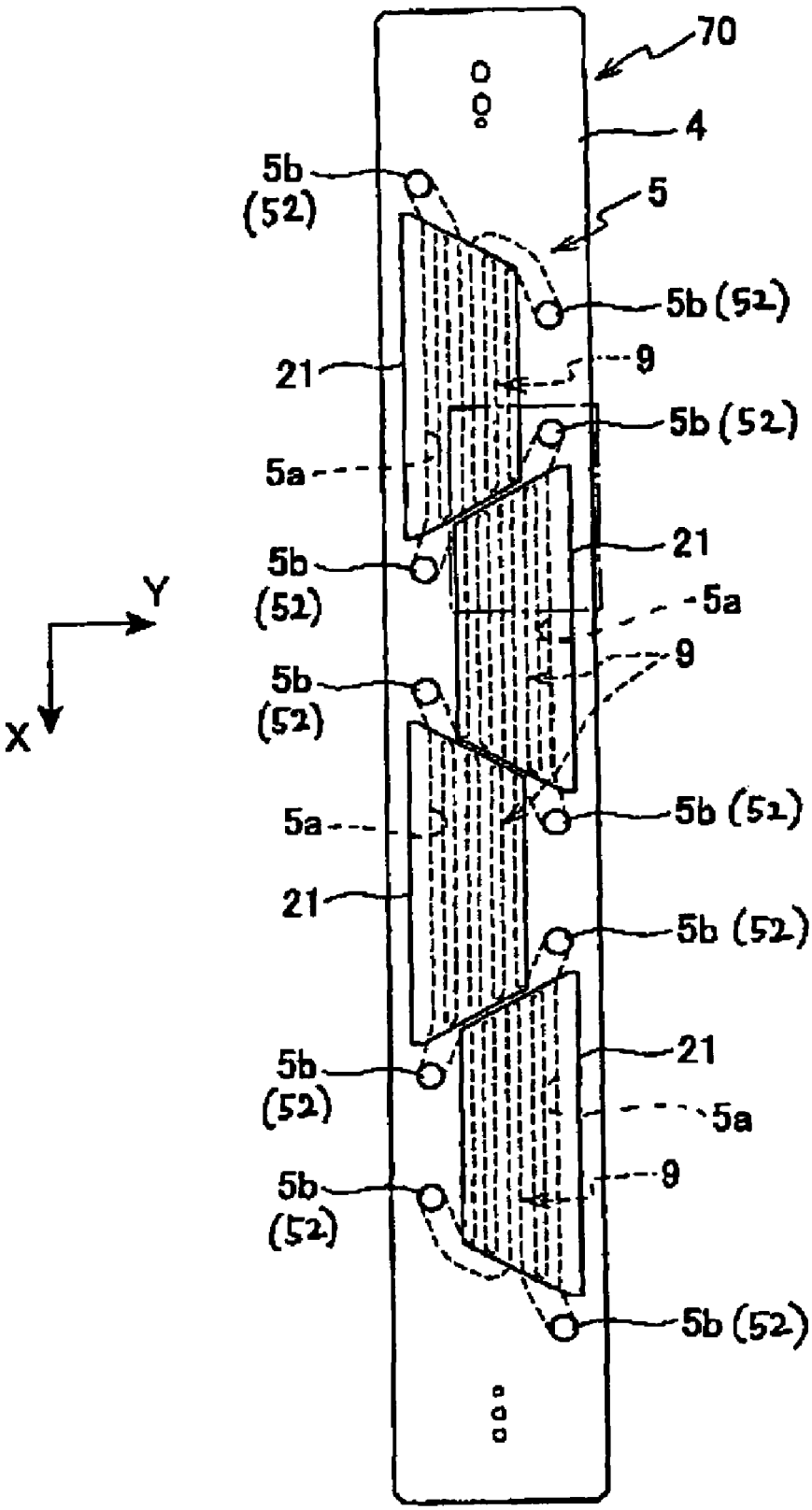
FIG. 5 is a plan view showing a main head shown in FIGS. 3(*a*) and 3(*b*)
Figure 10:
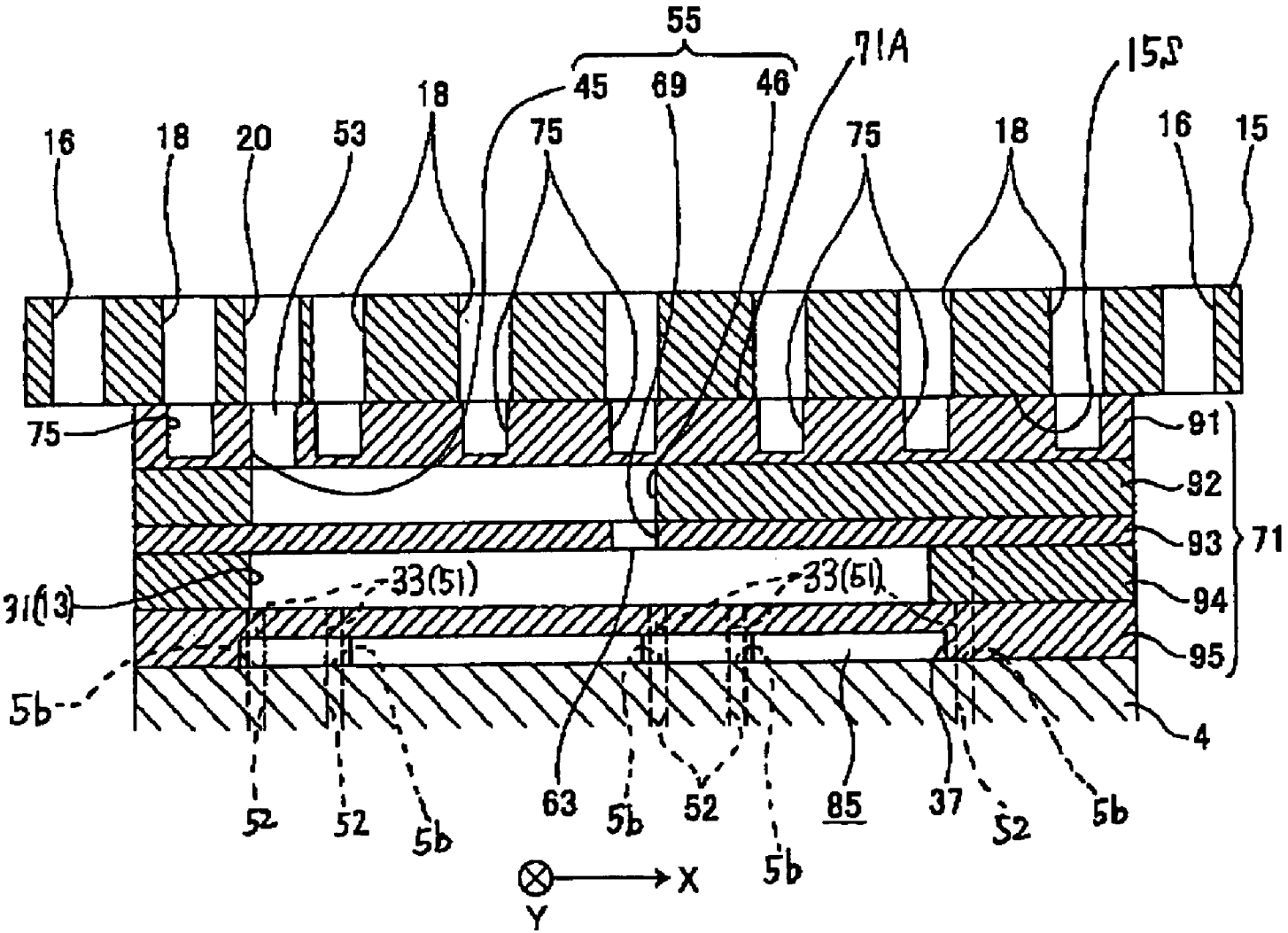
FIG. 10 is a cross-sectional view showing a reservoir unit and surrounding area of the inkjet head according to the first embodiment.

As shown in FIG. 10, the reservoir unit 71 includes an ink inlet 53 and an ink downflow channel 55. An ink tank (not shown) is in fluid communication with the ink inlet 53 via an ink supply tube (not shown). The ink downflow channel 55 has a downflow opening 63. Ink supplied from the ink tank (not shown) into the ink inlet 53 via the ink supply tube (not shown) flows through the ink downflow channel 55, through the downflow opening 63, and accumulates in the ink reservoir 13. Ink accumulated in the ink reservoir 13 is supplied from the plurality of the upper ink supply channels 51 to a plurality of lower ink supply channels 52, which are formed in the channel unit 4 in one-to-one correspondence with the upper ink supply channels 51 as shown in FIG. 3(*b*). A manifold (common ink chamber) 5 is also formed in the channel unit 4 as shown in FIG. 5. The lower ink supply channels 52 are in fluid communication with the manifold 5. The FPCs 50 connected to the actuator units 21 are also connected to a control unit (not shown) and control driving of the inkjet heads 1 based on commands from the control unit.

As shown in FIG. 3(*a*), the base plate 15 is approximately as wide as the main head member 70 and the reservoir unit 71 in the subscanning direction Y. The base plate 15 is formed in a rectangular planar shape slightly longer than the reservoir unit 71 in the longitudinal direction (main scanning direction X). Holes 16 are formed through the thickness of the base plate 15 in both longitudinal ends thereof and in portions of the base plate 15 not confronting the reservoir unit 71. The bottom surface (base surface 15S) of the base plate 15 that contacts the reservoir unit 71 is flat with no unevenness or warping.

For example, preferably the base surface 15S has a flatness of 0.05 mm or smaller. That is, a difference between a highest point and a lowest point in the surface is smaller than or equal to 0.05 mm. More preferably, the base surface 15S has a flatness of 0.01 mm or smaller. That is, a difference between a highest point and a lowest point in the surface is smaller than or equal to 0.01 mm.

Figure 4A:
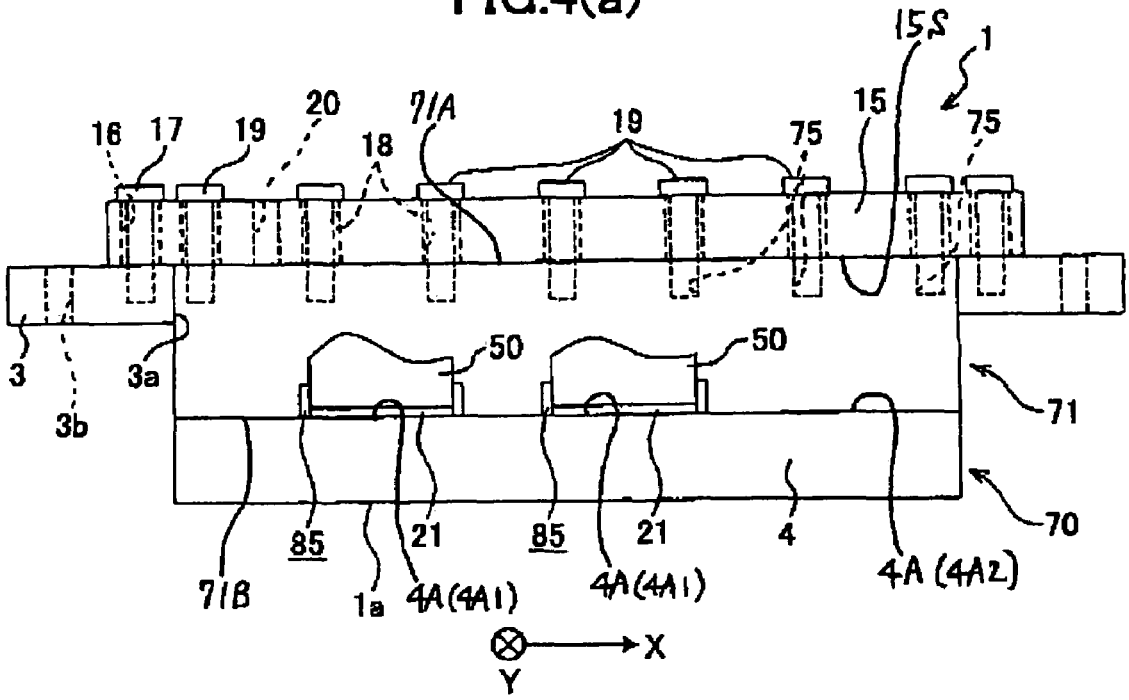
FIG. 4(*a*) is a side view of the inkjet head according to the first embodiment.
Figure 4B:
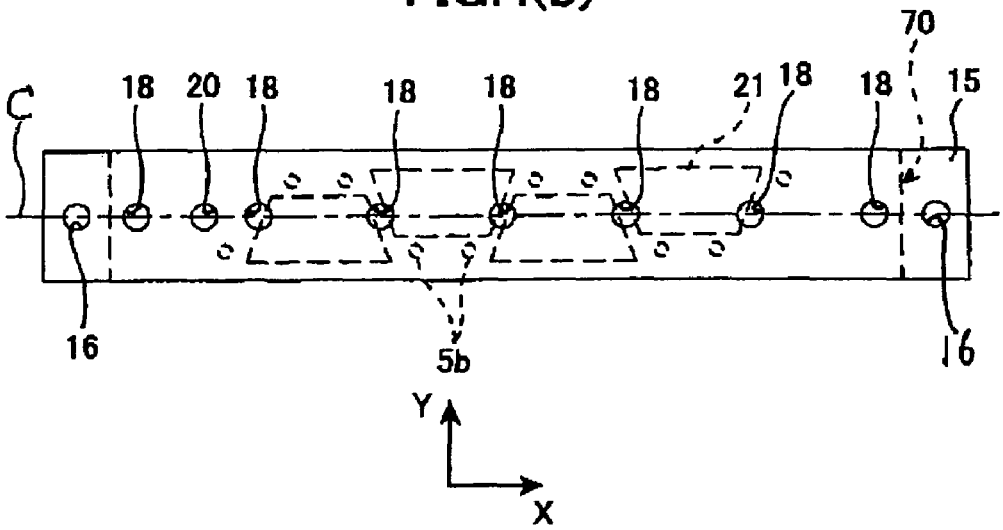

FIG. 4(*a*) is a side view and FIG. 4(*b*) a plan view of the inkjet head 1 according to the present embodiment. In FIG. 4(*b*), the planar surface of the main head member 70 is indicated by dotted lines. As shown in FIGS. 4(*a*) and 4(*b*), a plurality of through-holes 18 is formed in regions of the base plate 15 confronting the reservoir unit 71. The through-holes 18 are arranged at equal intervals in the longitudinal direction of the base plate 15 (main scanning direction X) so that the centers of the through-holes 18 overlap a centerline C extending in the longitudinal direction. As shown in FIG. 4(*b*), the through-holes 18 other than those formed on both ends in regions of the base plate 15 confronting the reservoir unit 71 are disposed so that their centers overlap regions between the actuator units 21 in a staggered arrangement. As shown in FIG. 4(*a*), the through-holes 18 are arranged to overlap each of screw holes 75 formed in a top surface 71A of the reservoir unit 71. The diameter of the through-holes 18 is formed slightly larger than the diameter of the screw holes 75. Bolts 19 are inserted through the through-holes 18 and threadingly engaged with the screw holes 75, thereby fixing the bottom surface (base surface) 15S of the base plate 15 tightly and closely to the entire top surface 71A of the reservoir unit 71.

As shown in FIGS. 4(*a*) and 4(*b*), a through-hole 20 is formed near the left end in the drawing in a region of the base plate 15 confronting the reservoir unit 71, so that the through-hole 20 overlaps the entire ink inlet 53 (FIG. 10). The through-hole 20 has a diameter slightly larger than a diameter of the ink inlet 53 so that the ink supply tube (not shown) that is connected with the ink inlet 53 can be accommodated in the through-hole 20.

Next, the structure of the main head member 70 will be described.

Figure 6:
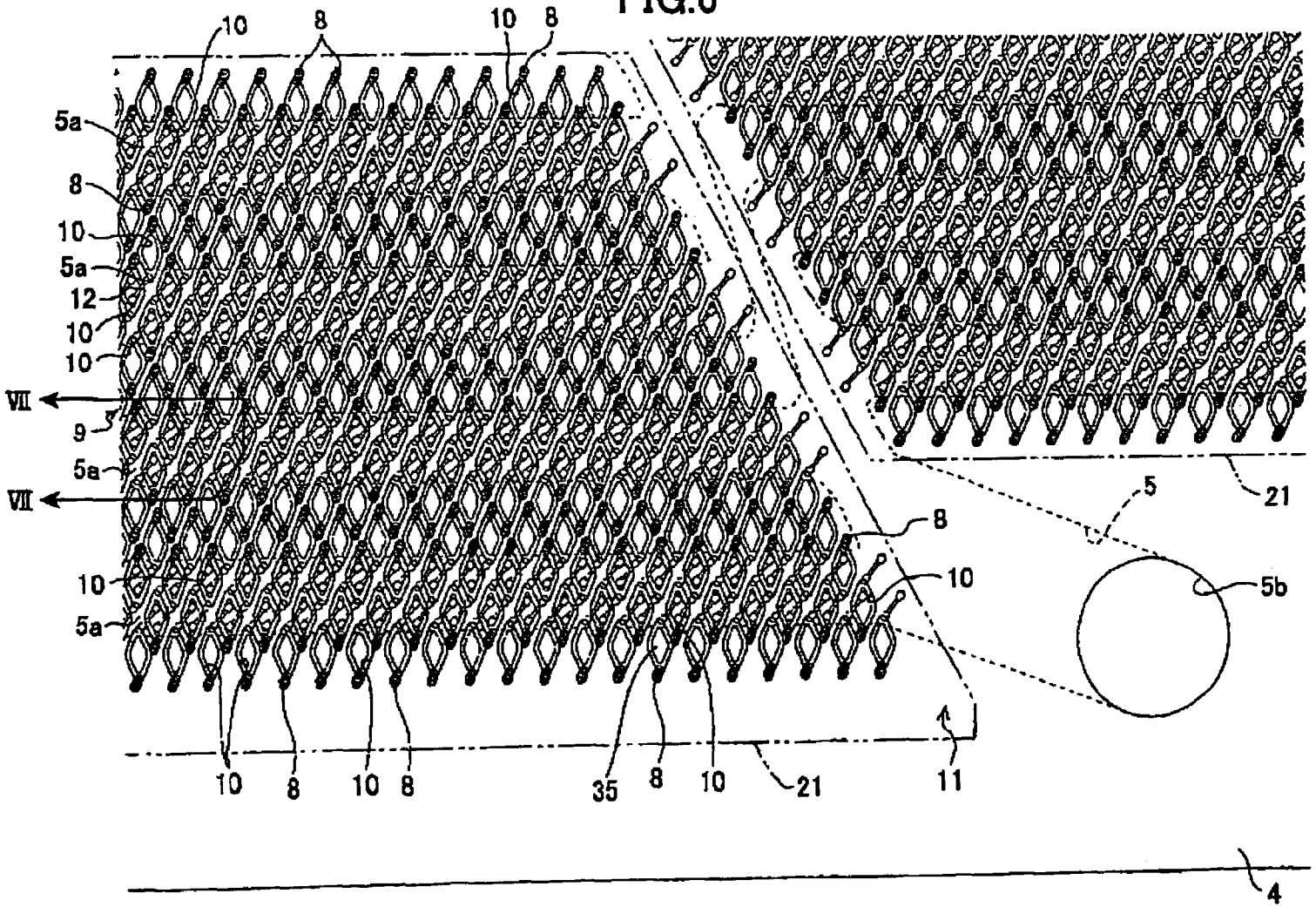
FIG. 6 is an enlarged plan view showing an area in FIG. 5 surrounded by a single-dot chain line.

FIG. 5 is a plan view showing the main head member 70 of FIG. 1. FIG. 6 is an enlarged plan view showing the region in FIG. 5 surrounded by a single-dot chain line. It is noted that for purposes of description, pressure chambers 10 (pressure chamber groups 9), apertures 12, and nozzles 8 (which will be described later) are depicted with solid lines in FIG. 6, although they are beneath the actuator units 21 and should be depicted in dotted lines.

Figure 7:
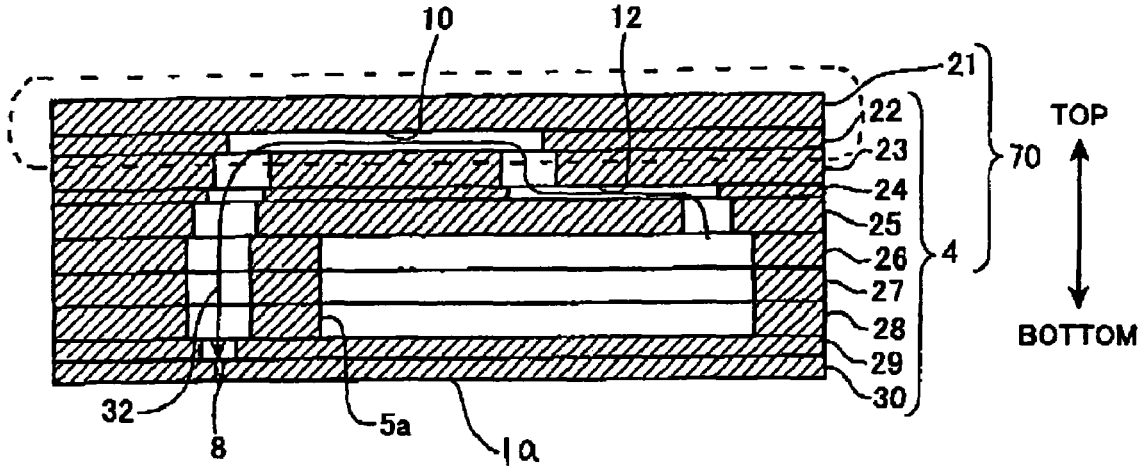
FIG. 7 is a cross-sectional view along a line VII-VII in FIG. 6.

As shown in FIGS. 5 and 6, the main head member 70 includes the channel unit 4. A plurality of (four, in this embodiment) actuator units 21 is bonded to the top surface of the channel unit 4. The actuator units 21 are disposed in a staggered arrangement of two rows on the top surface of the channel unit 4. The bottom surface of the channel unit 4 is the nozzle surface 1*a* (FIG. 7). Each actuator unit 21 has a trapezoidal-shape cross-section along a plane parallel to the top and bottom surfaces of the actuator unit 21. Each trapezoidal-shaped actuator unit 21 is positioned with its parallel sides (top and bottom sides of the trapezoid) aligned with the longitudinal direction (main scanning direction X) of the channel unit 4. The trapezoidal-shaped actuator units 21 are arranged on the top surface of the channel unit 4 so that the slanted sides (slanted sides of the trapezoids) of each two neighboring actuator units 21 confront with each other with a gap being formed therebetween. The confronting slanted sides of the neighboring actuator units 21 are partially overlapped with each other in the width direction (subscanning direction Y).

A plurality of (four, in this embodiment) ink ejection regions 11 (FIG. 6) are defined on the bottom surface of the channel unit 4 in one-to-one correspondence with a plurality of (four, in this embodiment) regions of the top surface of the channel unit 4, on which the plurality of (four, in this embodiment) actuator units 21 are bonded.

As shown in FIG. 6, numerous nozzles 8 are formed on the bottom surface of the channel unit 4 in each ink ejection region 11. The nozzles 8 are arranged in a matrix configuration in the ink ejection region 11. Numerous pressure chambers 10, each of which is in fluid communication with a single nozzle 8, are formed on the top surface of the channel unit 4 and are arranged also in a matrix configuration. A single pressure chamber group 9 is configured of a plurality of the pressure chambers 10 that are disposed on the top surface of the channel unit 4 in correspondence with the area in which a single actuator unit 21 is bonded. In this way, the numerous pressure chambers 10 are grouped into a plurality of (four, in this embodiment) pressure chamber groups 9. Each pressure chamber 10 has a substantially diamond-shaped cross-section along a plane parallel to the top and bottom surfaces of the chamber unit 4.

As shown in FIG. 7, each nozzle 8 grows narrower toward its tip end. Each nozzle 8 is in fluid communication with the sub-manifold 5*a* via a corresponding pressure chamber 10 and a corresponding aperture 12. The sub-manifold 5*a* is a branch channel of the manifold 5.

As shown in FIG. 5, a manifold 5 is formed inside the channel unit 4. The manifold 5 is configured from a plurality of sub-manifolds 5*a*. A plurality of (ten, in this embodiment) openings 5*b* are formed in the top surface of the channel unit 4 in fluid communication with the manifold 5. More specifically, a lower ink supply channel 52 extends from each opening 5*b* to corresponding sub-manifolds 5*a*.

As will be described with reference to FIG. 10, each opening 5*b* is joined with a corresponding upper ink supply channel 51, which is opened on the bottom surface of the reservoir unit 71. Ink in the reservoir unit 71 is therefore supplied through the upper ink supply channels 51 to the lower ink supply channels 52, and then to the sub-manifolds 5*a*.

Figure 8:
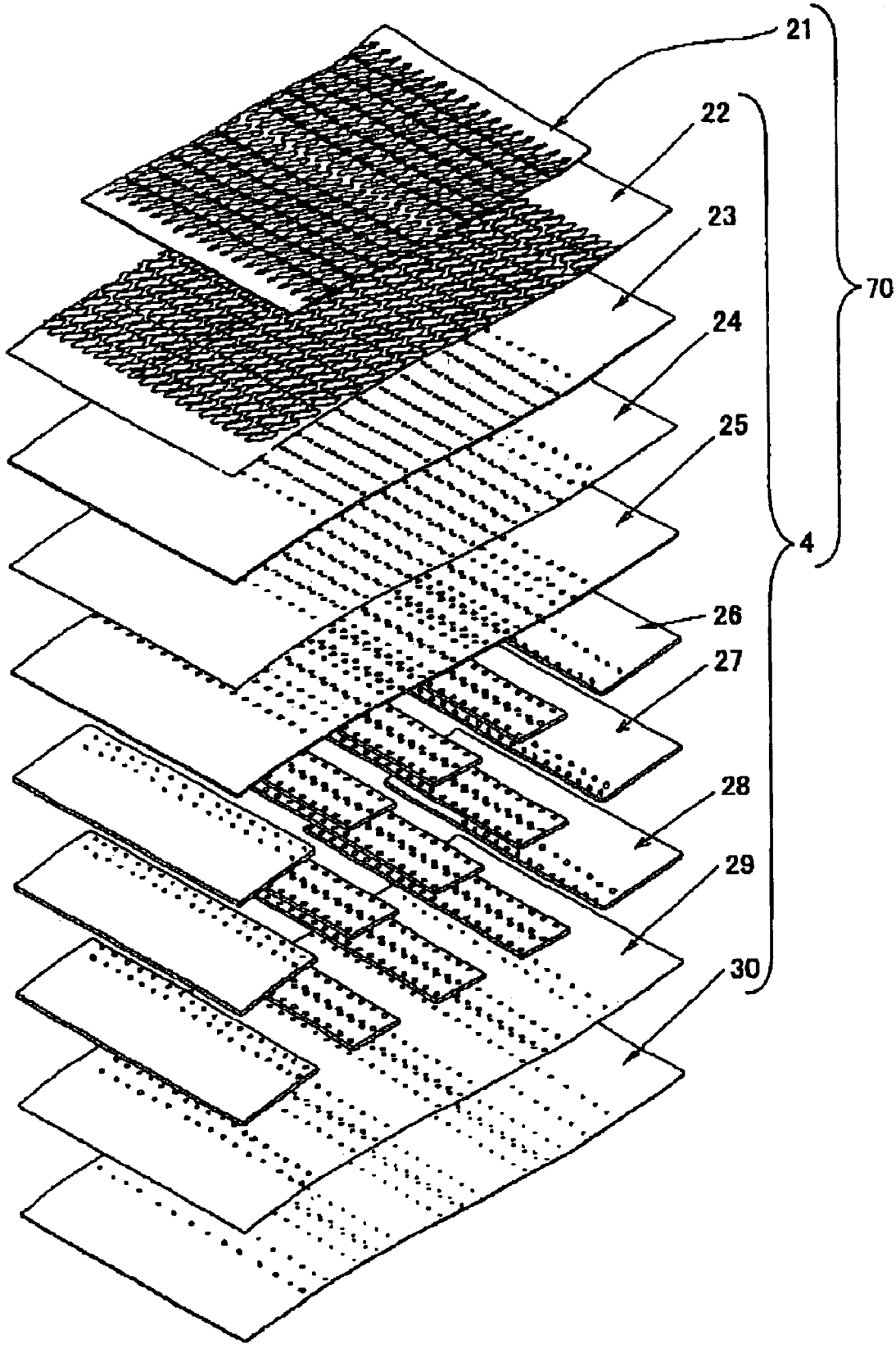
FIG. 8 is an exploded perspective view showing a portion of the main head depicted in FIG. 5.

Next, the cross-sectional structure of the main head member 70 will be described. FIG. 7 is a cross-sectional view taken along a line VII-VII in FIG. 6. FIG. 8 is an exploded perspective view showing a part of the main head member 70.

As shown in FIG. 7, each nozzle 8 is in fluid communication with a corresponding sub-manifold 5*a* via a corresponding pressure chamber 10 and a corresponding aperture 12. Accordingly, an individual ink channel 32 is formed in the main head member 70 for each pressure chamber 10 and extends from the outlet of the sub-manifold 5*a* to the nozzle 8 via the aperture 12 and the pressure chamber 10.

As shown in FIG. 8, the main head member 70 has a laminated structure that includes a total of ten stacked sheets. From top to bottom, these sheets include the actuator unit 21, a cavity plate 22, a base plate 23, an aperture plate 24, a supply plate 25, manifold plates 26, 27, and 28, a cover plate 29, and a nozzle plate 30. The channel unit 4 is configured of nine of these metal plates, excluding the actuator unit 21. These nine metal plates are formed of the same metal materials of stainless steel SUS316.

As will be described in detail later with reference to FIG. 9(*a*), the actuator unit 21 includes four laminated piezoelectric sheets 41-44, of which only the topmost sheet 41 has active layer portions (hereinafter referred to as the "layer having active layer") when an electric field is generated by electrodes, while the remaining three sheets 42-44 are inactive layers.

The cavity plate 22 is a metal plate provided with a plurality of substantially diamond-shaped openings (through-holes) defining the pressure chambers 10.

The base plate 23 is a metal plate. For each pressure chamber 10 in the cavity plate 22, the base plate 23 is formed with a communication through-hole connecting the pressure chamber 10 to a corresponding aperture 12 and another communication through-hole connecting the pressure chamber 10 to a corresponding nozzle 8.

The aperture plate 24 is a metal plate. For each pressure chamber 10 in the cavity plate 22, the aperture plate 24 is formed with the aperture 12 for each pressure chamber 10 in the cavity plate 22 and with a communication through-hole connecting the pressure chamber 10 to the nozzle 8. The aperture 12 is formed in the aperture plate 24 through an etching.

The supply plate 25 is a metal plate. For each pressure chamber 10 in the cavity plate 22, the supply plate 25 is provided with a communication through-hole connecting the aperture 12 and the sub-manifold 5*a* and a communication through-hole connecting the pressure chamber 10 with the nozzle 8.

The manifold plates 26, 27, and 28 are each provided with a through-hole for configuring the sub-manifold 5*a* when the plates are laminated together. For each pressure chamber 10 in the cavity plate 22, each plate 26, 27, and 28 is further formed with a communication through-hole connecting the pressure chamber 10 to the nozzle 8.

The cover plate 29 is a metal plate. For each pressure chamber 10 in the cavity plate 22, the cover plate 29 is provided with a communication through-hole connecting the pressure chamber 10 to the nozzle 8.

The nozzle plate 30 is a metal plate provided with the nozzle 8 for each pressure chamber 10 in the cavity plate 22.

These nine metal plates 22-30 are aligned and stacked together to form the ink channel 32 as shown in FIG. 7. The ink channel 32 begins from the sub-manifold 5*a* proceeding upward, extends horizontally in the aperture 12 before again proceeding upward, again extends horizontally in the pressure chamber 10, and then proceeds downward to the nozzle 8, first at a slant away from the aperture 12 and then straight downward.

Next, the structure of the actuator unit 21 will be described. FIG. 9(*a*) is an enlarged cross-sectional view of a part surrounded by a broken line in FIG. 7. FIG. 9(*b*) is a plan view showing the shape of an individual electrode 35 shown in FIG. 9(*a*). The actuator unit 21 is stacked on the cavity plate 22, which is the topmost layer of the channel unit 4.

Figure 9A:
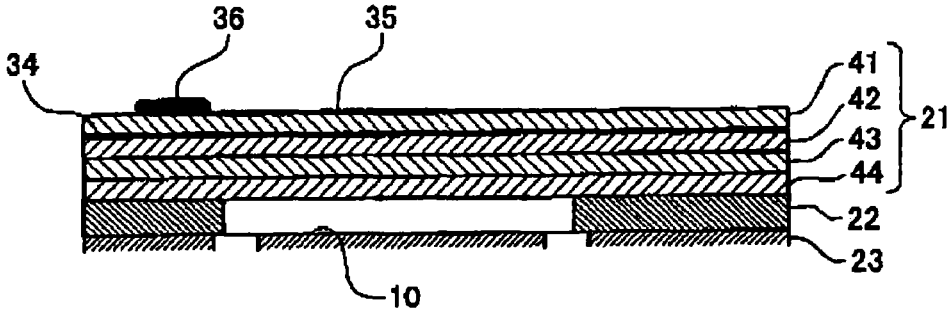
FIG. 9(*a*) is a partial cross-sectional view showing an actuator unit depicted in FIG. 7.
Figure 9B:
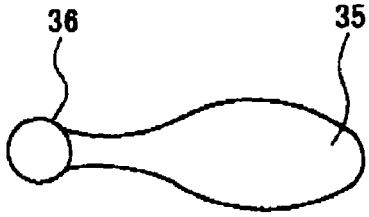

As shown in FIG. 9(*a*), the actuator unit 21 includes the four piezoelectric sheets 41-44, each having the same thickness of approximately 15 μm. These piezoelectric sheets 41-44 are continuous laminated plates (continuous planar layers) that span the plurality of pressure chambers 10 formed in a single ink ejection region 11 of the main head member 70 (FIGS. 5 and 6). By disposing the piezoelectric sheets 41-44 as continuous planar layers over the plurality of pressure chambers 10, individual electrodes 35 can be densely arranged on the piezoelectric sheet 41 using a screen printing technique or the like. Therefore, the pressure chambers 10 can also be densely arranged at positions corresponding to the individual electrodes 35, enabling the printing of high-resolution images. The piezoelectric sheets 41-44 are formed of ferroelectric ceramics such as lead zirconate titanate (PZT).

The individual electrodes 35 are formed on top of the piezoelectric sheet 41, the topmost layer. The individual electrodes 35 are bonded to the top surface of the piezoelectric sheet 41. A common electrode 34 formed as a sheet with a uniform thickness of approximately 2 μm is interposed between the piezoelectric sheets 41 and 42. Electrodes are not provided between the piezoelectric sheets 42 and 43 and between the piezoelectric sheets 43 and 44. Both the individual electrodes 35 and the common electrode 34 are formed of a metal material such as Ag—Pd.

Each of the individual electrodes 35 is planar with a thickness of approximately 1 μm and is substantially diamond-shaped, as shown in FIG. 9(*b*), similar to the pressure chambers 10 shown in FIG. 6. A circular land 36 having a diameter of approximately 160 μm protrudes upwardly from one acute angle end of the individual electrode 35. The circular land 36 is electrically connected to the individual electrode 35. The land 36 is formed of gold including glass frit, for example. As shown in FIG. 9(*a*), the land 36 is bonded to the surface of an extended part of the individual electrode 35. The land 36 is electrically joined to a contact (not shown) provided on the FPC 50.

The common electrode 34 is electrically grounded in an area not shown in the drawing, enabling the common electrode 34 to be maintained equally at a ground potential for all areas corresponding to the pressure chambers 10. Further, the individual electrodes 35 are connected to a control unit (not shown) via the lands 36 and the FPCs 50, which include a plurality of independent lead wires for the plurality of individual electrodes 35 in order to independently control the potential of the individual electrodes 35 corresponding to the plurality of pressure chambers 10.

Next, a method of driving the actuator unit 21 will be described. The polarizing direction of the piezoelectric sheet 41 is equal to the direction of its thickness. Specifically, the actuator unit 21 has a unimorph structure in which the single piezoelectric sheet 41 on the top side (separated from the pressure chamber 10) serves as active layers, while the three piezoelectric sheets 42-44 on the bottom side (near the pressure chamber 10) are inactive layers. Accordingly, when a predetermined positive or negative potential is applied to individual electrodes 35 and if the directions of the electric field and polarization are the same, for example, areas of the piezoelectric sheet 41, which are interposed between the electrodes 35 and the common electrode 34 and in which an electric field is applied, function as active layers and compress in a direction orthogonal to the polarizing direction due to the transverse piezoelectric effect. The piezoelectric sheets 42-44 are not affected by the electric field and therefore do not spontaneously compress. Accordingly, a difference in strain between the piezoelectric sheet 41 and the piezoelectric sheets 42-44 is produced in the direction orthogonal to the polarizing direction, causing all of the piezoelectric sheets 41-44 to deform in a convex shape on the inactive side (unimorph deformation).

As shown in FIG. 9(*a*), since the bottom surface of the actuator unit 21 is fixed to the top surface of the cavity plate 22, which serves to partition the pressure chambers 10, the piezoelectric sheets 41-44 effectively deform in a convex shape toward the pressure chamber 10 side. As a result, the volumes of the pressure chambers 10 decrease, increasing the pressure of the ink and causing ink to eject from the nozzles 8. When the individual electrodes 35 are subsequently returned to the same potential as the common electrode 34, the piezoelectric sheets 41-44 return to their original shape and the pressure chambers 10 return to their original volumes, drawing ink in from the manifold 5 side.

Figure 11:
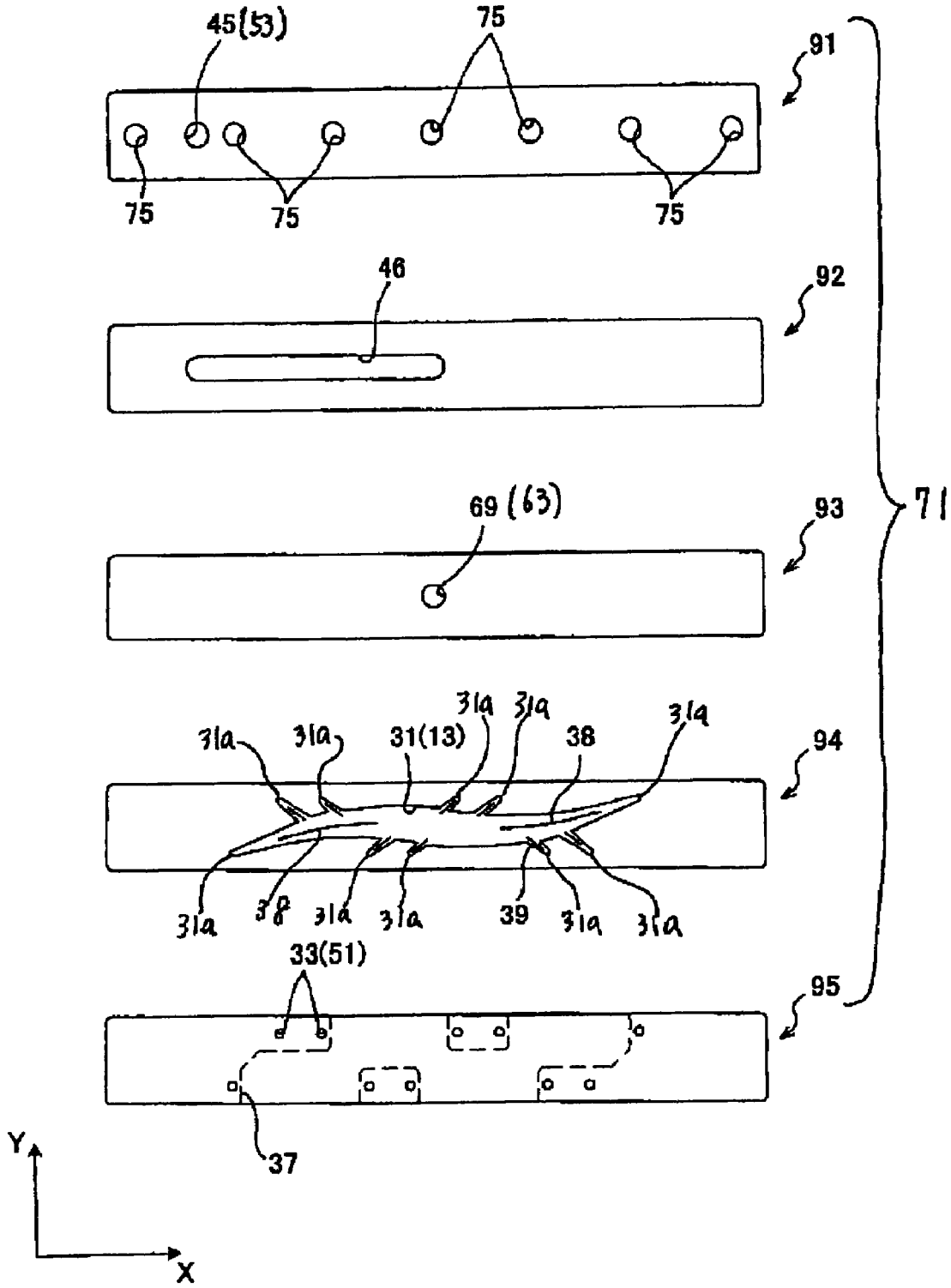
FIG. 11 is an exploded view of the reservoir unit in FIGS. 3(*a*) and 3(*b*)

Next, the structure of the reservoir unit 71 will be described in greater detail. FIG. 10 is a cross-sectional view showing the reservoir unit and surrounding area of the inkjet head 1 according to, the present embodiment. FIG. 11 is an exploded view of the reservoir unit 71, showing plan views of each plate constituting the reservoir unit 71.

As shown in FIG. 10, the reservoir unit 71 has a laminated structure including first through fifth plates 91-95. The plates 91-95 are rectangular in shape extending in the main scanning direction X and are formed of the same metal materials of the metal plates 22-30 in the channel unit 4 described above.

When aligned and laminated, the plates 91-95 form the ink downflow channel 55, the ink reservoir 13, and the upper ink supply channels 51 in the reservoir unit 71. The ink inlet 53 is provided as an opening on the upstream side of the ink downflow channel 55, while the downflow opening 63 is provided as another opening on the downstream side of the ink downflow channel 55. The ink inlet 53 is positioned at the edge on the top surface of the reservoir unit 71, while the downflow opening 63 confronts the center of the ink reservoir 13.

The ink reservoir 13 is in fluid communication with the ink downflow channel 55 via the downflow opening 63. The ink reservoir 13 is also in fluid communication with the ten upper ink supply channels 51. Five upper ink supply channels 51 are arranged along the main scanning direction X on each widthwise side of the reservoir unit 71. Since FIG. 10 is a cross-sectional view, only the five upper ink supply channels 51 and the five lower ink supply channels 52 formed on one widthwise side of the reservoir unit 71 are shown.

Next, each plate will be described in greater detail. A circular hole 45 is formed in one end of the first plate 91 in the main scanning direction X and near the center in the subscanning direction Y. The circular hole 45 has a circular shape in cross-section along a plane parallel to the base surface 15S. The open area at the top surface of the hole 45 constitutes the ink inlet 53. A plurality of the screw holes 75 is formed not to penetrate the thickness of the first plate 91. The screw holes 75 are formed at equal intervals along a centerline extending in the main scanning direction X so as to correspond to the through-holes 18 formed in the base plate 15. As shown in FIG. 10, the thickness of the first plate 91 is smaller than the thickness of the base plate 15.

As shown in FIGS. 10 and 11, an elongated through-hole 46 is formed in the second plate 92 penetrating the same in the thickness direction and extends parallel to the main scanning direction X from a position confronting the through-hole 45 to the center of the second plate 92 in the main scanning direction X.

A circular hole 69 is formed in the center of the third plate 93. The open area on the downstream side of the hole 69 constitutes the downflow opening 63.

A hole 31 is formed in the center of the fourth plate 94. Ten protruding tip ends 31*a* branch outward from the hole 31 at points corresponding to holes 33 formed in the fifth plate 95 and constituting the upper ink supply channels 51. The hole 31 constitutes the ink reservoirs 13.

Ten of the holes 33 are formed in the fifth plate 95. The holes 33 have a substantially circular shape in cross-section along a plane parallel to the base surface 15S. Five of the holes 33 are formed along the main scanning direction X on both sides of the fifth plate 95 with respect to the subscanning direction Y. As shown in FIG. 11, the holes 33 formed in opposing sides of the fifth plate 95 with respect to the subscanning direction Y are staggered in the main scanning direction X by two units of two holes 33 and one unit of one hole 33 that is near an end of the fifth plate 95 in the main scanning direction X, and are symmetrical about a center point of the fifth plate 95 (the center point with respect to both the main scanning direction X and the subscanning direction Y). The holes 33 constitute the upper ink supply channels 51. A recess 37 is also formed by half etching in the surface of the fifth plate 95 confronting the channel unit 4. The shape of the recess 37 is defined by both the broken line in FIG. 11 and the outer edges of the fifth plate 95 following the main scanning direction X. The recess 37 forms the space 85 described above when the fifth plate 95 is stacked on the top surface of the channel unit 4, as shown in FIG. 10. The recess 37 is also open on the outer sides in the subscanning direction Y.

When a thermosetting adhesive is applied between each of the first through fifth plates 91-95 and the plates are bonded together by applying heat and pressure, the reservoir unit 71 configured of the plates 91-95 does not warp in a direction perpendicular to the top surface or bottom surface thereof, because the plates 91-95 are formed of the same metal materials. In other words, because the plates 91-95 are formed of the same metal materials, the linear expansion coefficients of the plates are equal to one another and hence each of the plates expands equally within the plane parallel to the top and bottom surfaces thereof when heat and pressure are applied. Accordingly, the reservoir unit 71 configured by joining the plates 91-95 with heat and pressure does not warp. In the present embodiment, both the channel unit 4 and the reservoir unit 71 are configured of metal plates to improve the durability of the inkjet head 1.

Next, the ink channels in the reservoir unit 71 will be described.

Ink supplied from an ink tank (not shown) into the ink downflow channel 55 via the ink inlet 53 flows down into the ink reservoir 13 through the downflow opening 63. The ink inlet 53 is formed on one end of the reservoir unit 71 in the main scanning direction X. The downflow opening 63 (circular through-hole 69) is formed at a position confronting the center region of the ink reservoir 13. The ink downflow channel 55 is constituted by the circular hole 45, the elongated through-hole 46, and the circular hole 69, and is an ink channel from the ink inlet 53 to the downflow opening 63.

The ink reservoir 13 serves not only to store ink, but also to supply ink to the upper ink supply channels 51. The ink reservoir 13 is in fluid communication with the upper ink supply channels 51 at the ten tip ends 31*a*.

The ink reservoir 13 includes a main channel 38 and is eight subsidiary channels 39. The main channel 38 extends in the main scanning direction X and tapers from the center of the ink reservoir 13 toward two tip ends 31*a*, which are located near both ends of the plate 94 in the main scanning direction X. The eight subsidiary channels 39 branch off the main channel 38 and taper toward eight tip ends 31*a*, which are located on both sides of the plate 94 in the sub-scanning direction Y.

The ten tip ends 31*a* are positioned in correspondence with the ten through-holes 33 constituting the upper ink supply channels 51 formed in the plate 95 and are in fluid communication with the through-holes 33. The ten tip ends 31*a* are arranged in two rows in the reservoir unit 71 along the main scanning direction X, with five tip ends 31*a* located on each side of the reservoir unit 71 in the subscanning direction Y. The tip ends 31*a* on opposing sides are staggered in units of one formed near an end in the main scanning direction X and the remainder in units of two. The ink reservoir 13 has a cross-sectional shape, along a plane parallel to the top and bottom surfaces of the plate 94, that is symmetrical about a center point of the plate 94 with respect to the main scanning direction X, the center point being the point, at which ink flows from the downflow opening 63 into the ink reservoir 13.

The upper ink supply channels 51 are in fluid communication with the ink reservoir 13 on their upstream sides and are in fluid communication with the manifold 5 via the lower ink supply channels 52 on their downstream sides. The upper ink supply channels 51 receive ink from the ink reservoir 13 and supply ink to the manifold 5. As shown in FIG. 11, the upper ink supply channels 51 are formed in two rows along the main scanning direction X, with five on each side of the reservoir unit 71 in the subscanning direction Y, and are located in one-to-one correspondence with the tip ends 31*a* of the ink reservoir 13. The upper ink supply channels 51 on opposing sides of the reservoir unit 71 are staggered in units of two, except for one upper ink supply channel 51 formed near both ends of the reservoir unit 71 in the main scanning direction X. Hence, the upper ink supply channels 51 are arranged symmetrically about a center point of the plate 95 with respect to both the main scanning direction X and the subscanning direction Y that corresponds to the point at which ink flows into the ink reservoir 13 from the downflow opening 63.

Next, the flow of ink in the reservoir unit 71 will be described.

Ink introduced into the ink inlet 53 of the reservoir unit 71 from an ink tank not shown in the drawings flows vertically (in the direction in which the plates 91-95 constituting the reservoir unit 71 are stacked) down into the ink downflow channel 55. Ink that reaches the ink downflow channel 55 flows substantially in the main scanning direction X horizontally along the elongated through-hole 46 (the direction along the planar surfaces of the plates 91-95). Then, the ink forms a vertical flow and flows down through the downflow opening 63 into the center region of the ink reservoir 13. From the center region of the ink reservoir 13, the ink flows toward both tip ends 31*a* of the main channel 38 in the main scanning direction X. A portion of ink reaches the tip ends 31*a* at the ends of the main channel 38, and flows into the upper ink supply channels 51. A remaining portion of the ink that flows through the main channel 38 flows into the plurality of subsidiary channels 39 branching off the main channel 38. Ink reaching the end of these subsidiary channels 39 flows into the upper ink supply channels 51. Ink introduced into the upper ink supply channels 51 flows through the upper, ink supply channels 51 into the lower ink supply channels 52 of the channel unit 4 and is supplied to the manifold 5.

With the inkjet head 1 according to the present embodiment described above, the base surface (bottom surface) 15S of the base plate 15 confronting the reservoir unit 71 is flat with no bumps or warping. Hence, the reservoir unit 71 forms a close contact with the bottom surface 15S of the base plate 15 when fixed to the base plate 15 by the bolts 19, without bending in a direction orthogonal to the upper and lower surfaces of the reservoir unit 71. Since the upper and lower (nozzle surface 1*a*) surfaces of the channel unit 4 bonded to the reservoir unit 71 are also corrected to be parallel to the bottom surface (base surface) 15S of the base plate 15, the flatness of the nozzle surface 1*a* is improved. Therefore, when the frame 3 is fixed to the supporting portion 103 of the inkjet printer 101, the distance between the nozzle surface 1*a* and the paper conveying surface 108*a* is substantially uniform at all points, thereby eliminating variations in the accuracy of ink ejected onto paper. More specifically, when the nozzle surface bends slightly in a direction orthogonal to the surface, the distance between the nozzles 8 and the paper conveying surface differs for each nozzle 8, producing variations in the accuracy of ink ejected onto the conveyed paper. However, in the present embodiment, the base plate 15 ensures that the nozzle surface 1*a* is flat with no bending. Further, when the base plate 15 is fixed to the supporting portion 103 via the frame 3, the bottom surface 15S of the base plate 15 becomes parallel to the paper conveying surface 108*a*, making the distance between the nozzles 8 and the paper conveying surface 108*a* uniform for each nozzle 8 and thereby preventing irregularity in ink ejection accuracy.

Further, since the reservoir unit 71 is fixed to the base plate 15 by the plurality of bolts 19, bending at any point on the nozzle surface 1*a* in a direction orthogonal to the surface can be easily eliminated through adjustments. In other words, it is possible to correct bending in the nozzle surface 1*a* simply by adjusting the tightness of each bolt 19, thereby effectively improving the flatness over the entire nozzle surface 1*a*. Further, since the plurality of bolts 19 are disposed at equal intervals, bends can be eliminated from the nozzle surface 1*a* to form a uniform flatness throughout.

Note that, in the inkjet head 1 in the present embodiment, the base plate 15 is fixed to the reservoir unit 71 such that the entire base surface 15S is in close contact with the entire top surface 71A of the reservoir unit 71. Hence, it is normally unnecessary to adjust the tightness of each bolt 19. However, when warping of the reservoir unit 71 is large, it is sometimes preferable to adjust the tightness of each bolt 19.

Since the bolts 19 overlap the areas between adjacent actuator units 21, the ink ejection area of the nozzle surface 1*a* effectively follows the bottom surface 15S of the base plate 15, thereby ensuring a uniform distance between the ink ejection area of the nozzle surface 1*a* and the paper conveying surface 108*a* at all points.

In the present embodiment described above, the inkjet heads 1 are fixed to the frame 3 to constitute the inkjet head assembly 2, and the inkjet head assembly 2 is fixed to the main chassis 102. Accordingly, assembly is simplified and workability is improved. Further, when the inkjet head assembly 2 is fixed to the main chassis 102, the bottom surface 15S of the base plate 15 is parallel to the paper conveying surface 108*a*, achieving the inkjet printer 101 capable of suppressing variations in ink ejection accuracy.

Figure 12:
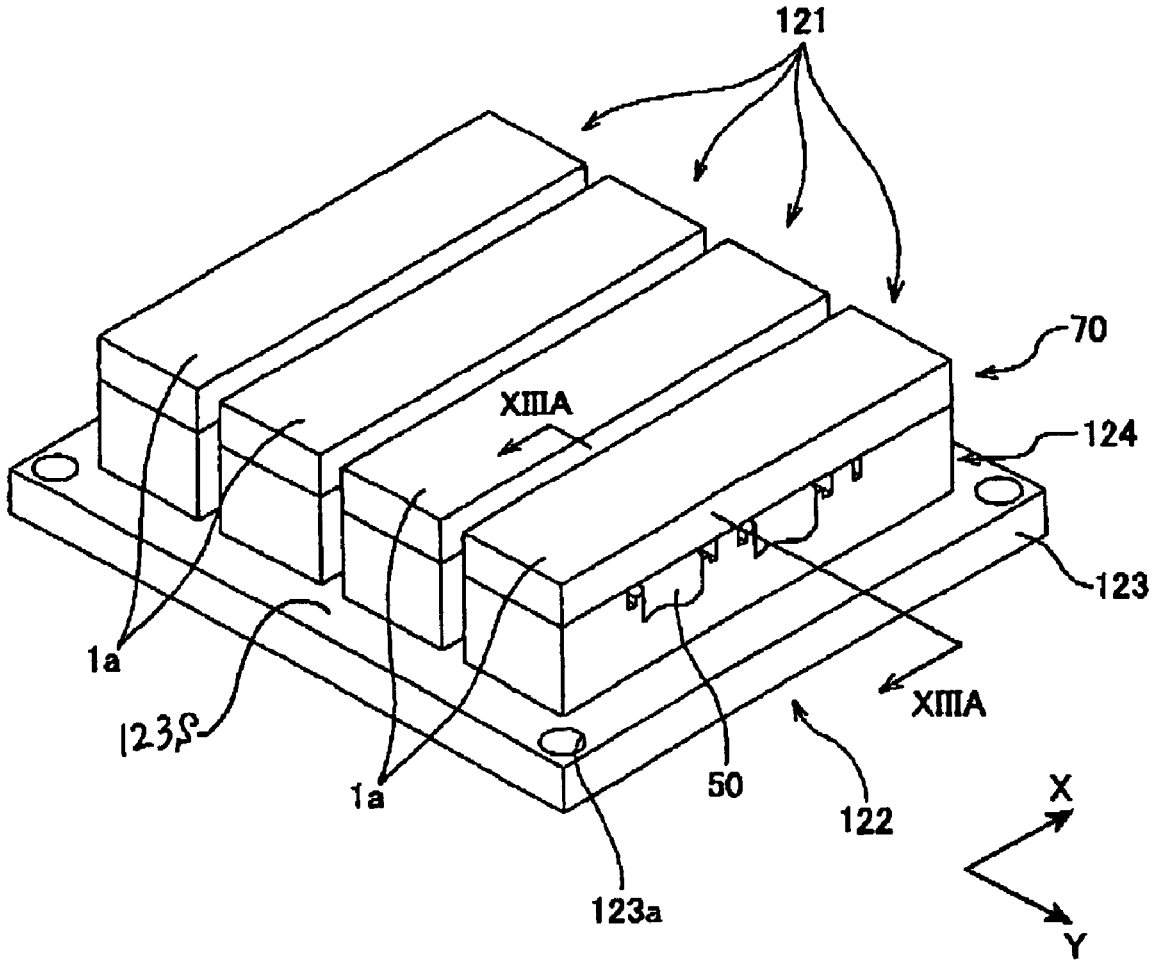
FIG. 12 is a perspective view showing an inkjet head assembly including inkjet heads according to a second embodiment of the present invention, where the inkjet head assembly is shown upside down.
Figure 13A:
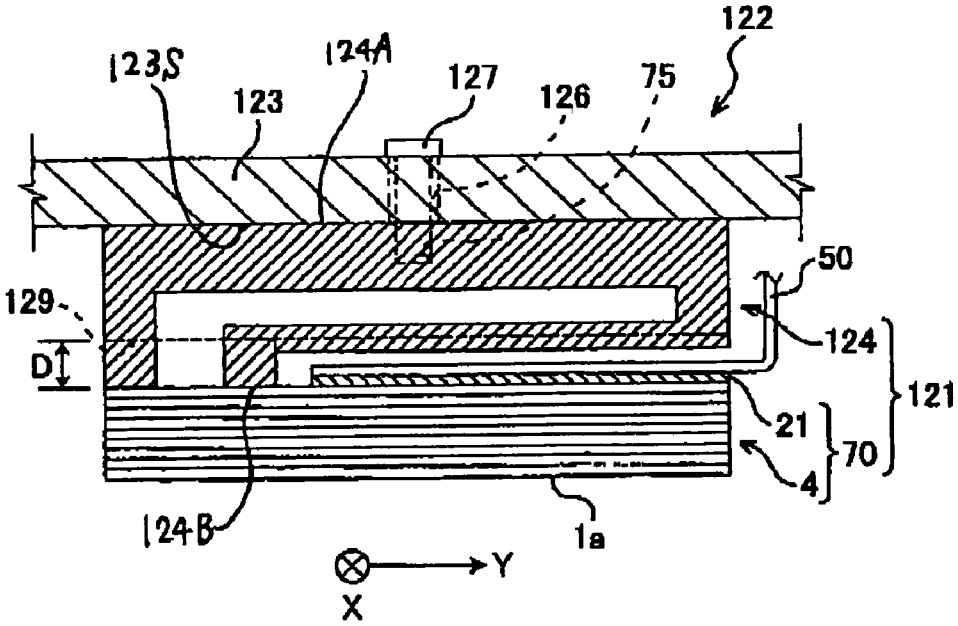
FIG. 13(*a*) is a cross-sectional view of the inkjet head according to the second embodiment along a line XIIIA-XIIIA in FIG. 12.
Figure 13B:
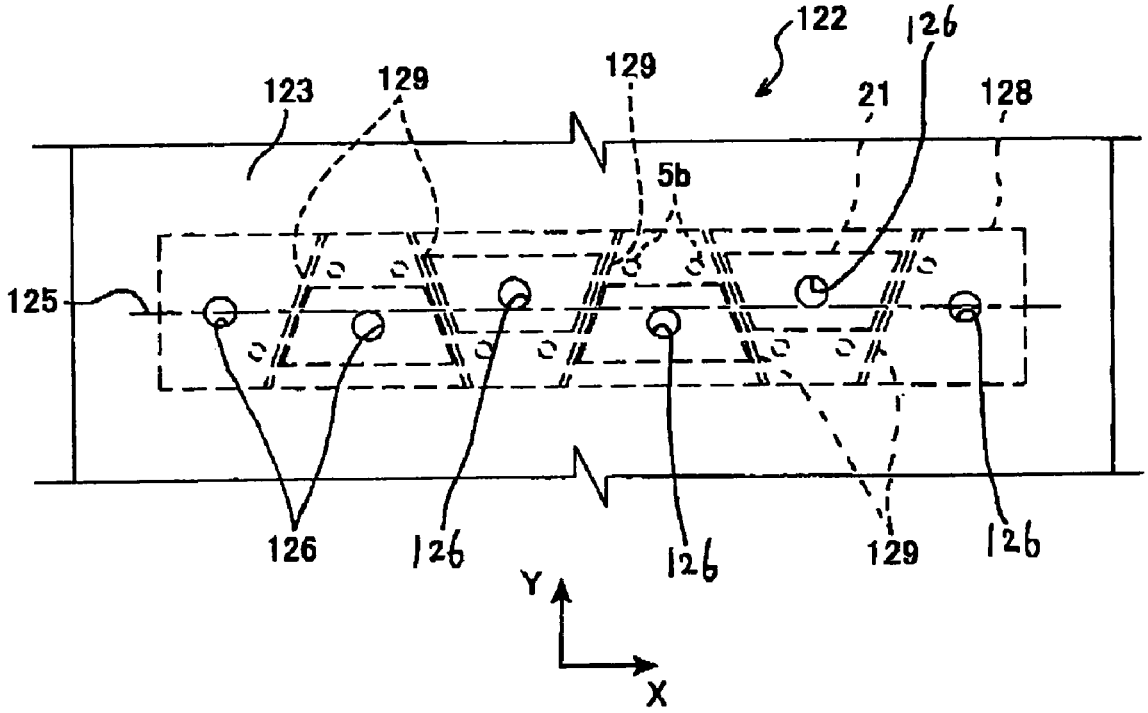

Next, an inkjet head according to a second embodiment of the present invention will be described while referring to the accompanying drawings. FIG. 12 is a perspective view showing an inkjet head assembly 122 positioned upside down. FIG. 13(*a*) is a cross-sectional view along a line XIIIA-XIIIA in FIG. 12, and FIG. 13(*b*) is a plan view showing an inkjet head 121 according to the second embodiment of the present invention. The planar surface of the main head is indicated by dotted lines in FIG. 13(*b*). Further, like parts and components are designated by the same reference numerals to avoid duplicating description.

As shown in FIG. 12, the inkjet head assembly 122 includes four inkjet heads 121 each having the main head member 70 described above and a reservoir unit 124 fixed to a base plate (reference plate) 123. The base plate 123 has a substantially square shape and has a base surface (bottom surface) 123S with a larger area than the base surface 15S of the first embodiment. As with the base plate 15, the base surface 123S of the base plate 123 confronting the inkjet head 121 is flat with no irregularities or warping. As with the through-holes 3*b* of the frame 3 described above (FIG. 2), through-holes 123*a* are formed through the thickness of the base plate 123 at each of the four corners thereof for fixing the base plate 123 to the supporting portion 103 (FIG. 1) protruding from the main chassis 102 by screws (not shown). When the base plate 123 is fixed to the supporting portion 103, the bottom surface 123S of the base plate 123 (the surface confronting the inkjet head 121) is parallel to the paper conveying surface 108*a*.

As shown in FIG. 13(*b*), a plurality of through-holes 126 is formed in an area 128 (indicated by dashed lines in FIG. 13(*b*)) of the inkjet head 121 confronting the reservoir unit 124. The through-holes 126 formed at both longitudinal ends in the area 128 are positioned with the centers of the through-holes 126 overlapping a centerline 125 that extends in the longitudinal direction of the area 128 (main scanning direction X). The remaining four through-holes 126 other than those formed on the ends of the area 128 are disposed so that the centers of the through-holes 126 substantially match the centers of the actuator units 21 depicted by dotted lines in FIG. 13(*b*). Hence, these four through-holes 126 are staggered in the longitudinal direction of the area 128 on either side of the centerline 125.

As shown in FIG. 13(*a*), while the reservoir unit 124 of the inkjet head 121 is configured similarly to the reservoir unit 71 described above, a plurality of slits 129 is formed in a bottom surface 124B of the reservoir unit 124 confronting the channel unit 4. The screw holes 75 formed in the reservoir unit 124 are identical to the screw holes of the reservoir unit 71 described above, except for their positions, and a description of these screw holes 75 will be omitted.

As shown in FIG. 13(*a*), the slits 129 are formed to open in the bottom surface 124B and has a depth (height) D. That is, the slits 129 are formed in the reservoir unit 124 so as to open toward the channel unit 4. As shown in FIG. 13(*b*), the slits 129 are formed to extend along the slanted sides of the actuator units 21.

As shown in FIG. 13(*a*), the inkjet head 121 including the reservoir unit 124 is fixed to the base plate 123 by inserting bolts 127 through the through-holes 126 in the base plate 123 and threadingly engaging the bolts 127 with the screw holes 75. Four inkjet heads 121 are arranged, as shown in FIG. 12. In this way, an entire top surface 124A of the reservoir unit 124 is fixed tightly and closely to the base surface 123S of the base plate 123 by the bolts 127.

With the inkjet head assembly 122 having the inkjet heads 121 according to the second embodiment described above, the base surface (bottom surface) 123S of the base plate 123 confronting the reservoir unit 124 is flat with no irregularities or warping, as with the bottom surface 15S of the inkjet head 1 of the first embodiment. Accordingly, the reservoir unit 124 is fixed tightly to the bottom surface 123S of the base plate 123 by the bolts 127, eliminating bending in the top surface and bottom surface of the reservoir unit 124 in a direction orthogonal to the surfaces. Accordingly, both the top surface and bottom surface (nozzle surface 1*a*) of the channel unit 4 bonded to the reservoir unit 124 are flat without bending in a direction orthogonal to the planar direction, thereby improving the flatness of the nozzle surface 1*a*. Hence, the inkjet head 121 of the second embodiment achieves similar effects obtained by the inkjet head 1 described above.

Further, since the bolts 127 are disposed to substantially match the centers of the actuator units 21, the ink ejection area of the nozzle surface 1*a*, in particular, that opposes the bonded region of the actuator units 21 effectively follows the bottom surface 123S of the base plate 123. Accordingly, the distance between the ink ejection area of the nozzle surface 1*a* and the paper conveying surface 108*a* is uniform at all points. Further, by providing the slits 129 in the bottom surface 124B of the reservoir unit 124 confronting the channel unit 4, the reservoir unit 124 can easily flex vertically along the longitudinal direction to form a tighter bond with the base plate 123, thereby improving the flatness on the bottom surface 124B of the reservoir unit 124 and the flatness of the nozzle surface 1*a*.

Since the centers of the actuator units 21 staggered on the top surface of the channel unit 4 substantially match the centers of the through-holes 126, they also substantially match the centers of the bolts 127. Hence, the bolts 127 are arranged in a staggered formation along the reservoir unit 124 in the longitudinal direction, enabling an inkjet head to have uniform flatness over the entire nozzle surface 1*a*. More specifically, if the actuator units are arranged in a single row parallel to the longitudinal direction of the channel unit (main scanning direction X), it is not possible to completely correct bending in the widthwise direction (subscanning direction Y) of the nozzle surface with bolts when the channel unit Slants to one widthwise side. However, by disposing the actuator units 21 in a staggered formation in the present embodiment and also staggering the bolts 127 to substantially match the centers of the actuator units 21, bending in the reservoir unit 124 and the channel unit 4 in the widthwise direction can be corrected to achieve an inkjet head having an extremely flat nozzle surface 1*a*.

Further, in the second embodiment, four of the inkjet heads 121 are disposed on the base plate 123 to form the inkjet head assembly 122 as a single unit. Hence, as with the inkjet head assembly 2 described above, the inkjet head assembly 122 can easily be mounted in the main chassis of the inkjet printer, thereby improving workability.

In the first embodiment, the through-holes 18 are formed at positions corresponding to gaps between neighboring actuator units 21 (FIG. 4(*b*)). In the second embodiment, the through-holes 126 are formed at positions each corresponding to a center of each of regions occupied by the actuator units 21 (FIG. 13(*b*)). Accordingly, by disposing bolts 19 at positions corresponding to regions of the nozzle surface 1*a* in which the nozzles 8 are formed, the flatness of these regions can be improved, thereby effectively improving flatness with a limited number of bolts.

While the invention has been described in detail with reference to the specific embodiment thereof, it would be apparent to those skilled in the art that various changes and modifications may be made therein without departing from the spirit of the invention.

Figure 14:
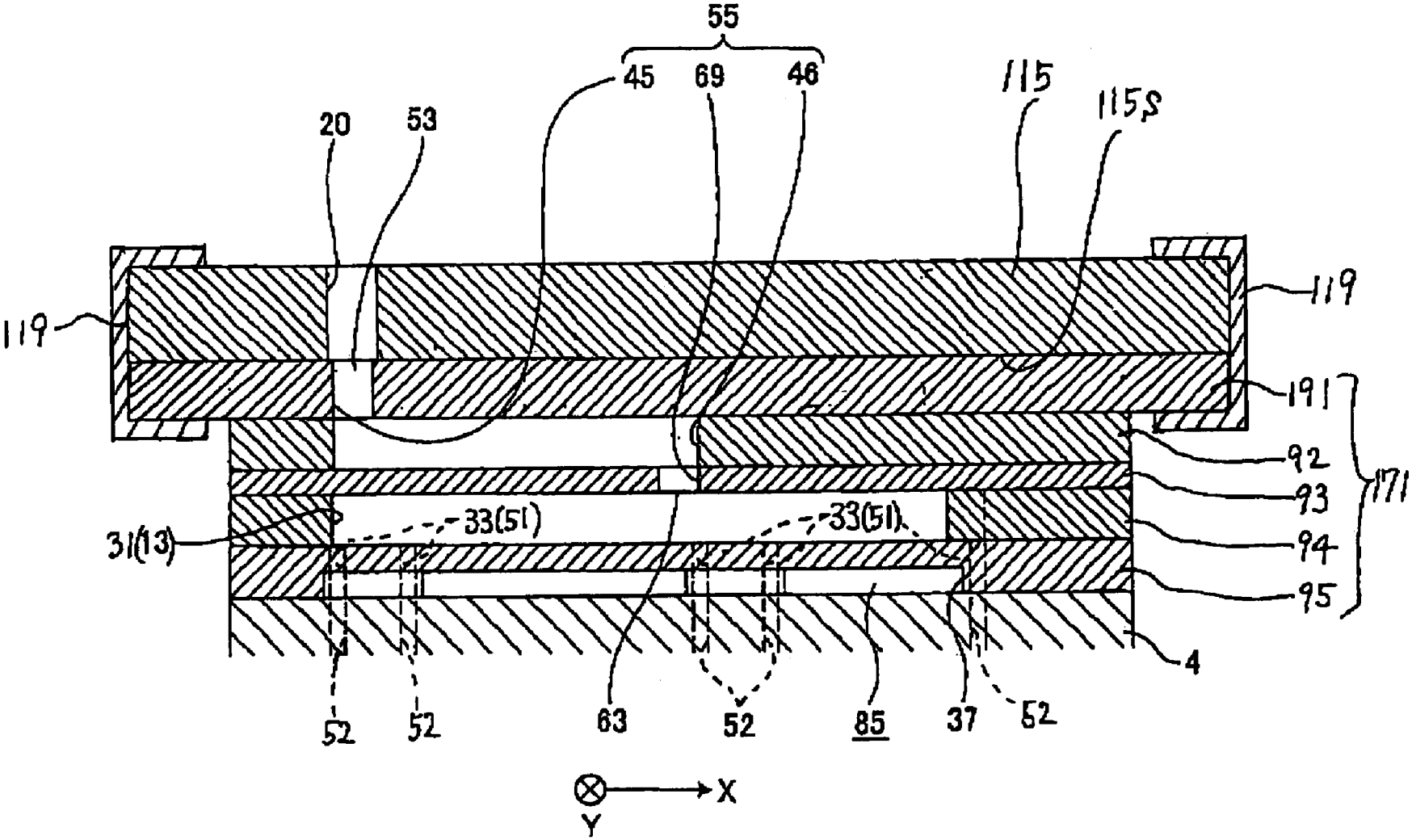
FIG. 14 is a cross-sectional view showing a reservoir unit and surrounding area of an inkjet head according to a modification in which fixing members are provided to fix the reservoir unit to a base plate.

For example, the means for fixing the reservoir units 71 and 124 to the base plates 15 and 123 may be a fixing means other than bolts. For instance, as shown in FIG. 14, a first plate 191 configuring part of a reservoir unit 171 may be made longer than the other plates 92-95 in the longitudinal direction (main scanning direction X). In this modification, fixing members 119 are used to fix the reservoir unit 171 to a base plate 115 having a base surface 115S. The fixing members 119 sandwich both ends of the base plate 115 and the first plate 191.

In the above-described embodiments, a plurality of bolts 19 is disposed to fix the reservoir units 71 and 124 to the base plates 15 and 123 respectively. However, the bolts 19 may be disposed at least at both longitudinal ends. Alternatively, the bolt 19 may be disposed at least at the center of the reservoir units 71 and 124 in the longitudinal direction. If the bolts 19 are disposed at least at both longitudinal ends or at the center of the reservoir units 71 and 124, other bolts 19 can be disposed at arbitrary locations. That is, the bolts 19 may be disposed at arbitrary locations, as long as the reservoir unit is fixed tightly and closely to the base plate.

In the second embodiment, the slits 129 are formed in the reservoir unit 124. However, the slits 129 may be eliminated.

What is claimed is:

1. An inkjet head comprising:

a channel unit having an ink ejection surface that includes a plurality of nozzles for ejecting ink, another surface opposite to the ink ejection surface, a common ink chamber, a plurality of pressure chambers each having a volume, and a plurality of individual ink channels each fluidly connecting the common ink chamber with one of the plurality of nozzles via a corresponding one of the plurality of pressure chambers;

an actuator portion fixed to a portion of the another surface, the actuator portion comprising a plurality of actuator units being deformable to selectively change the volumes of the plurality of pressure chambers, thereby applying pressure to ink therein;

a reservoir unit having a first surface fixed to another portion of the another surface, a second surface being opposite to the first surface and extending in parallel with the ink ejection surface, and an ink reservoir accommodating ink to be supplied to the common ink chamber, the reservoir unit extending in a longitudinal direction, the actuator portion being interposed between the channel unit and the reservoir unit;

a base plate having a flat planar surface; and a fixing portion fixing the base plate to the reservoir unit at a plurality of positions along the longitudinal direction, allowing the flat planar surface of the base plate to be in close contact with a longitudinal entirety of the second surface of the reservoir unit, the positions being equally spaced and arranged corresponding to the centers of the actuator units or the gaps between adjacent actuator units, wherein the actuator units are disposed between the channel unit and the reservoir unit.

2. The inkjet head as claimed in claim 1, wherein a plurality of through-holes is formed in the base plate at positions along the longitudinal direction, and a plurality of screw holes is formed in the reservoir unit at positions corresponding to the positions at which the plurality of through-holes is formed; and wherein the fixing portion includes a plurality of bolts inserted through the plurality of through-holes and threadingly engaged with the screw holes, allowing the plurality of bolts to be positioned along the longitudinal direction.

3. The inkjet head as claimed in claim 1, wherein the flat planar surface has a flatness of 0.05 mm or smaller.

4. The inkjet head as claimed in claim 1, the reservoir unit comprising a plurality of stacked plates having equal linear expansion coefficients, the plurality of stacked plates being connected by adjoining a bottom surface of each plate with the respective top surface of a corresponding plate.

5. The inkjet head as claimed in claim 2, wherein the plurality of bolts are positioned at equal intervals along the longitudinal direction.

6. The inkjet head as claimed in claim 2, wherein the plurality of nozzles are disposed within regions corresponding to regions occupied by the plurality of actuator units; and wherein the plurality of bolts are inserted through the plurality of through-holes and threadingly engaged with the plurality of screw holes at positions corresponding to gaps between neighboring actuator units.

7. The inkjet head as claimed in claim 2, wherein the plurality of nozzles are disposed within regions corresponding to regions occupied by the plurality of actuator units; and wherein both the plurality of through-holes and the plurality of screw holes are formed at positions each corresponding to a center of each of the regions occupied by the plurality of actuator units.

8. The inkjet head as claimed in claim 3, wherein the flat planar surface has a flatness of 0.01 mm or smaller.

9. The inkjet head as claimed in claim 7, wherein the another surface of the channel unit extends in parallel with the flat planar surface of the base plate; and wherein the plurality of actuator units are arranged on the another surface in a staggered formation along the longitudinal direction.

10. The inkjet head as claimed in claim 7, wherein recessed slits are formed in the first surface of the reservoir unit, the recessed slits being formed along gaps between adjacent actuator units and along directions intersecting the longitudinal direction.

11. An inkjet head assembly comprising:

a frame; and a plurality of inkjet heads, each of the plurality of inkjet heads including:

a channel unit having an ink ejection surface that includes a plurality of nozzles for ejecting ink, another surface opposite to the ink ejection surface, a common ink chamber, a plurality of pressure chambers each having a volume, and a plurality of individual ink channels each fluidly connecting the common ink chamber with one of the plurality of nozzles via a corresponding one of the plurality of pressure chambers;

an actuator portion fixed to a portion of the another surface, the actuator portion comprising a plurality of actuator units being deformable to selectively change the volumes of the plurality of pressure chambers, thereby applying pressure to ink therein;

a reservoir unit having a first surface fixed to another portion of the another surface, a second surface being opposite to the first surface and extending in parallel with the ink ejection surface, and an ink reservoir accommodating ink to be supplied to the common ink chamber, the reservoir unit extending in a longitudinal direction, the actuator portion being interposed between the channel unit and the reservoir unit;

a base plate having a flat planar surface and supported by the frame; and a fixing portion fixing the base plate to the reservoir unit at a plurality of positions along the longitudinal direction, allowing the flat planar surface of the base plate to be in close contact with a longitudinal entirety of the second surface of the reservoir unit, the positions being equally spaced and arranged corresponding to the centers of the actuator units or the gaps between adjacent actuator units, wherein the actuator units are disposed between the channel unit and the reservoir unit.

12. The inkjet head assembly as claimed in claim 11, wherein the frame has an opening and supports the plurality of inkjet heads such that all of the plurality of nozzles provided in the plurality of inkjet heads is positioned in the opening.

13. The inkjet head as claimed in claim 11, the reservoir unit comprising a plurality of stacked plates having equal linear expansion coefficients, the plurality of stacked plates being connected by adjoining a bottom surface of each plate with the respective top surface of a corresponding plate.

14. An inkjet head assembly comprising:

a plurality of inkjet heads, each of the plurality of inkjet heads including:

a channel unit having an ink ejection surface that includes a plurality of nozzles for ejecting ink, another surface opposite to the ink ejection surface, a common ink chamber, a plurality of pressure chambers each having a volume, and a plurality of individual ink channels each fluidly connecting the common ink chamber with one of the plurality of nozzles via a corresponding one of the plurality of pressure chambers;

an actuator portion fixed to a portion of the another surface, the actuator portion comprising a plurality of actuator units being deformable to selectively change the volumes of the plurality of pressure chambers, thereby applying pressure to ink therein; and a reservoir unit having a first surface fixed to another portion of the another surface, a second surface being opposite to the first surface and extending in parallel with the ink ejection surface, and an ink reservoir accommodating ink to be supplied to the common ink chamber, the reservoir unit extending in a longitudinal direction, the actuator portion being interposed between the channel unit and the reservoir unit;

a base plate having a flat planar surface; and a fixing portion fixing the base plate to each reservoir unit at a plurality of positions along the longitudinal direction, allowing the flat planar surface of the base plate to be in close contact with a longitudinal entirety of the second surface of each reservoir unit, the positions being equally spaced and arranged corresponding to the centers of the actuator units or the gaps between adjacent actuator units, wherein the actuator units are disposed between the channel unit and the reservoir unit.

15. The inkjet head as claimed in claim 14, the reservoir unit comprising a plurality of stacked plates having equal linear expansion coefficients, the plurality of stacked plates being connected by adjoining a bottom surface of each plate with the respective top surface of a corresponding plate.

16. An inkjet printer comprising:

a main chassis;

a recording-medium conveying unit having a conveying surface for conveying a recording medium thereon; and an inkjet head assembly including:

a frame supported by the main chassis; and a plurality of inkjet heads, each of the plurality of inkjet heads including:

a channel unit having an ink ejection surface that includes a plurality of nozzles for ejecting ink, another surface opposite to the ink ejection surface, a common ink chamber, a plurality of pressure chambers each having a volume, and a plurality of individual ink channels each fluidly connecting the common ink chamber with one of the plurality of nozzles via a corresponding one of the plurality of pressure chambers;

an actuator portion fixed to a portion of the another surface, the actuator portion comprising a plurality of actuator units being deformable to selectively change the volumes of the plurality of pressure chambers, thereby applying pressure to ink therein;

a reservoir unit having a first surface fixed to another portion of the another surface, a second surface being opposite to the first surface and extending in parallel with the ink ejection surface, and an ink reservoir accommodating ink to be supplied to the common ink chamber, the reservoir unit extending in a longitudinal direction, the actuator portion being interposed between the channel unit and the reservoir unit;

a base plate having a flat planar surface and supported by the frame; and a fixing portion fixing the base plate to the reservoir unit at a plurality of positions along the longitudinal direction, allowing the flat planar surface of the base plate to be in close contact with a longitudinal entirety of the second surface of the reservoir unit, thereby disposing the ink ejection surface in parallel with the conveying surface, the positions being equally spaced and arranged corresponding to the centers of the actuator units or the gaps between adjacent actuator units, wherein the actuator units are disposed between the channel unit and the reservoir unit.

17. The inkjet head as claimed in claim 16, the reservoir unit comprising a plurality of stacked plates having equal linear expansion coefficients, the plurality of stacked plates being connected by adjoining a bottom surface of each plate with the respective top surface of a corresponding plate.

18. An inkjet head comprising:

a channel unit having an ink ejection surface that includes a plurality of nozzles for ejecting ink, another surface opposite to the ink ejection surface, a common ink chamber, a plurality of pressure chambers each having a volume, and a plurality of individual ink channels each fluidly connecting the common ink chamber with one of the plurality of nozzles via a corresponding one of the plurality of pressure chambers;

an actuator portion fixed to a portion of the another surface, the actuator portion comprising a plurality of actuator units being deformable to selectively change the volumes of the plurality of pressure chambers, thereby applying pressure to ink therein;

a reservoir unit having a first surface fixed to another portion of the another surface, a second surface being opposite to the first surface and extending in parallel with the ink ejection surface, and an ink reservoir accommodating ink to be supplied to the common ink chamber, the reservoir unit extending in a longitudinal direction, the actuator portion being interposed between the channel unit and the reservoir unit, wherein recessed slits are formed in the first surface of the reservoir unit, the recessed slits being formed along gaps between adjacent actuator units and along directions intersecting the longitudinal direction;

a base plate having a flat planar surface; and a fixing portion fixing the base plate to the reservoir unit at a plurality of positions along the longitudinal direction, allowing the flat planar surface of the base plate to be in close contact with a longitudinal entirety of the second surface of the reservoir unit, each of the positions corresponding to the centers of the actuator units or the gaps between adjacent actuator units, wherein the actuator units are disposed between the channel unit and the reservoir unit.

* * * * *